US007994445B2

(12) United States Patent
Aihara et al.

(10) Patent No.: US 7,994,445 B2
(45) Date of Patent: Aug. 9, 2011

(54) SHEET SWITCH, SHEET SWITCH MODULE AND PANEL SWITCH

(75) Inventors: Kenshi Aihara, Fujiyoshida (JP); Isao Miyashita, Fujiyoshida (JP)

(73) Assignee: Citizen Electronics Co., Ltd., Yamanashi (JP)

( * ) Notice: Subject to any disclaimer, the term of this patent is extended or adjusted under 35 U.S.C. 154(b) by 1221 days.

(21) Appl. No.: 11/504,786

(22) Filed: Aug. 16, 2006

(65) Prior Publication Data

US 2007/0039809 A1 Feb. 22, 2007

(30) Foreign Application Priority Data

Aug. 19, 2005 (JP) ..... P2005-239129
Sep. 21, 2005 (JP) ..... P2005-274618

(51) Int. Cl.
*H01H 9/00* (2006.01)

(52) U.S. Cl. ..... 200/314; 200/310; 200/516

(58) Field of Classification Search ..... 200/344, 200/406, 516; 362/602
See application file for complete search history.

(56) References Cited

U.S. PATENT DOCUMENTS 5,876,107 A 3/1999 Parker et al.
6,806,815 B1 * 10/2004 Kaikuranta et al. ..... 341/22
6,860,612 B2 * 3/2005 Chiang et al. ..... 362/29
6,997,572 B2 * 2/2006 Ono et al. ..... 362/24
7,053,799 B2 * 5/2006 Yu et al. ..... 341/31
7,340,273 B2 * 3/2008 Ono ..... 455/550.1

FOREIGN PATENT DOCUMENTS

JP 2004-069751 3/2004

OTHER PUBLICATIONS

Office Action/Communication in corresponding Chinese Patent Application No. 200610115953.8, dated Jan. 22, 2010.
English translation of relevant part of Office Action issued Jan. 22, 2010 in corresponding Chinese Patent Application No. 200610115953.8.

* cited by examiner

*Primary Examiner* — Edwin A. Leon
*Assistant Examiner* — Lheiren Mae A Caroc
(74) *Attorney, Agent, or Firm* — Browdy and Neimark, PLLC

(57) ABSTRACT

A sheet switch module including a sheet switch (21) having a central contact (32) disposed on a circuit board (33), a circumferential contact (20) disposed circumferentially of the central contact (32), a spring (22) disposed above the central contact (32), and a transparent sheet member (23) configured to cover the spring (22), the sheet switch (21) forming a switching circuit such that the spring (22) provides electrical conduction between the central contact (32) and the circumferential contact (20) when the sheet member is pressed, the sheet member (23) being formed by a light guiding sheet (30) configured to guide light emitted from an LED (34) along an upper surface of the spring (22).

20 Claims, 19 Drawing Sheets

SHEET SWITCH, SHEET SWITCH MODULE AND PANEL SWITCH

CROSS-REFERENCE TO THE RELATED APPLICATIONS

This application is based on and claims priority from each of Japanese Patent Application No. 2005-239129, filed on Aug. 19, 2005, and Japanese Patent Application No. 2005-274618, filed on Sep. 21, 2005, the contents of which are incorporated herein by reference.

BACKGROUND OF THE INVENTION

1. Field of the Invention

The present invention relates to a sheet switch to be used for a thinned electronic instrument such as a mobile phone or the like, a sheet switch module which is configured to add an illumination function to the sheet switch and a panel switch in which the sheet switch module is installed.

2. Description of Related Art

A conventional key switch provided in an operational panel installed in each of various electronic instruments such as mobile phones, mobile information terminals, or the like, often includes a key top disposed to allow for pressing of each of a plurality of springs and an illumination structure to illuminate the key top. The illumination structure is configured such that each of the key tops is illuminated by a light source, for example, a light emitting diode (LED), or such that a group of key tops is illuminated by means of a light guiding plate by one or more LEDs, thereby allowing the position of each key top to be clearly recognized (for reference, see Japanese Patent Laid-Open No. 2004-69751, FIG. 9).

FIG. 19 illustrates one example of a conventional key switch 1. The key switch 1 includes a plurality of key switch portions 1*a* provided on a circuit board 2 and an illumination structure 1*b* to illuminate the key switch portions 1*a*. Each of the key switch portions 1*a* includes a central contact 3 disposed on the circuit board 2, a circumferential contact 8 disposed circumferentially of the central contact 3, a spring 4 disposed on the circumferential contact 8 to face the central contact 3, and a hey top 7 having a rod 7*a* which is disposed above and facing the spring 4. The rod 7*a* presses a top surface of the spring 4.

The illumination structure includes a light guiding plate 5 disposed above the circuit board 2 and a plurality of LEDs 6, each of which is disposed on the circuit board 2 to illuminate a side surface of the light guiding plate 5. The rod 7*a* of each key top 7 extends downward through the light guiding plate 5. In addition, wiring patterns (not shown) are formed on the circuit board 2.

In the key switch 1, the key tops 7 as a whole are lighted by the light guiding plate 5 illuminated by the LEDs 6.

Another known example of conventional key switch is a thinned key switch having an illumination structure developed in response to the recent trend towards thinning of electronic instruments (for reference, see Japanese Patent Laid-Open No. 2004-69751, FIG. 6).

FIG. 20 illustrates a sectioned structure of such a conventional thinned key switch 11.

The key switch 11 includes a plurality of sheet switch portions 19 provided on a circuit board 12 and an illumination structure to illuminate the key tops 17. Each of the sheet switch portions 19 includes a central contact 13 disposed on the circuit board 12, a circumferential contact 18 disposed circumferentially of the central contact 13, a spring 14 disposed to face the central contact 13, and a key top 17 disposed to face the spring 14.

The illumination structure includes a light guiding plate 15 disposed to cover the area above the sheet switch portions 19 and a plurality of LEDs 16, each of which is disposed on the circuit board 12 to illuminate one side surface of the light guiding plate 15.

In the key switch 11, the light guiding plate 15 is disposed between the key top 17 and the spring 14. The light guiding plate 15 as a whole is lighted by illuminating the side surface of the light guiding plate 15 with light emitted from the LEDs 16, thereby allowing a lower surface of each of the key tops 17 to be illuminated.

However, because each of the above-mentioned conventional key switches has the structure in which each of the key tops 17 which controls each of the springs is illuminated by the corresponding light guiding plate 15, there is a problem that the key top 17 and the light guiding plate 15 must be provided separately from the spring 14, and this results in a key switch 11 having an increased thickness.

In addition, in the conventional key switch 1, as shown in FIG. 19, because the rod 7*a* of each of the key tops 7 extends downward through the light guiding plate 5, the area of the light guiding plate illuminating the key tops is reduced, and a thickness of each light guiding plate 5 must be increased more than a certain value to allow sufficient illumination of the key tops. Increasing the overall thickness of the light guiding plate results in increased thickness of the key switch, thus making it difficult to achieve a thinned key switch.

On the other hand, in the conventional key switch 11 shown in FIG. 20, because the light guiding plate 15 is disposed between each of the key tops 17 and each of the springs 14, the light guiding plate 15 must be thinned and elastic in nature in order to allow for controlling the spring 14 by the key top 17; therefore it is not possible for the light guiding plate 15 to retain sufficient light therein. Consequently, there is a problem that the key tops 17 have low brightness and that variations in brightness are marked.

The key switch also has a structure in which a gap may arise between the light guiding plate 15 and each spring 14, and also between the light guiding plate 15 and each of the LEDs 16. If there is a gap in the circumference of the light guiding plate 15, light leaks trough the gap, leading to a problem of insufficient light illuminating each key top and insufficient brightness of the key tops.

Therefore, in the above-mentioned conventional key switches 1 and 11, it is not possible to obtain a thinned and effective key switch which illuminates the key tops 17 exclusively.

SUMMARY OF THE INVENTION

An object of the present invention is to provide a sheet switch of simple structure thinned as much as possible, a sheet switch module provided with an illumination function allowing light to be guided efficiently in the sheet switch, and a flat-type panel switch which, by installation of the sheet switch module therein, is capable of being thinned and exhibits high brightness.

To accomplish the above objective, a sheet switch according to one embodiment of the present invention includes a structure in which a spring confirmed to provide electrical conduction between a central contact is disposed on a circuit board and a circumferential contact is disposed circumferentially of the central contact on the circuit board, and a sheet member configured to cover the spring. Usually, a sheet switch includes a plurality of springs, central contacts, and circumferential contacts therein.

The sheet member is formed by a thin translucent resinous film.

A sheet switch module according to another embodiment of the present invention includes a circuit board, a structure in which a central contact is disposed on the circuit board, a circumferential contact is disposed circumferentially of the central contact on the circuit board, a spring is disposed on the circumferential contact over the central contact and able to provide contact between the central contact and the circumferential contact, and also includes a sheet member configured to cover the spring. Usually, in the sheet switch module, a plurality of springs, central contacts, and circumferential contacts are provided.

The spring is configured to form a switching circuit such that the spring makes electrical contact between the central contact and the circumferential contact when the sheet member is pressed. The sheet member is disposed on the circuit board and is formed by a light guiding sheet, which covers the plurality of springs, and is configured to guide light emitted from a light source.

The sheet switch module further includes an illumination structure to supply light to the light guiding sheet member. The illumination structure has at least one light emitting diode (LED) as a light source to introduce light into the light guiding sheet member.

A panel switch according to still another embodiment of the present invention includes the sheet switch module and a surface sheet having at least one key top portion disposed above the circumferential contact of the sheet switch module.

DETAILED DESCRIPTION OF THE PREFERRED EMBODIMENTS

Preferred embodiments of the present invention will be explained in detail with reference to the accompanying drawings below.

One embodiment of a sheet switch 21 according to the present invention and a first embodiment of a sheet switch module to which the sheet switch is applied are first explained referring to FIGS. 1 to 5.

Figure 1:
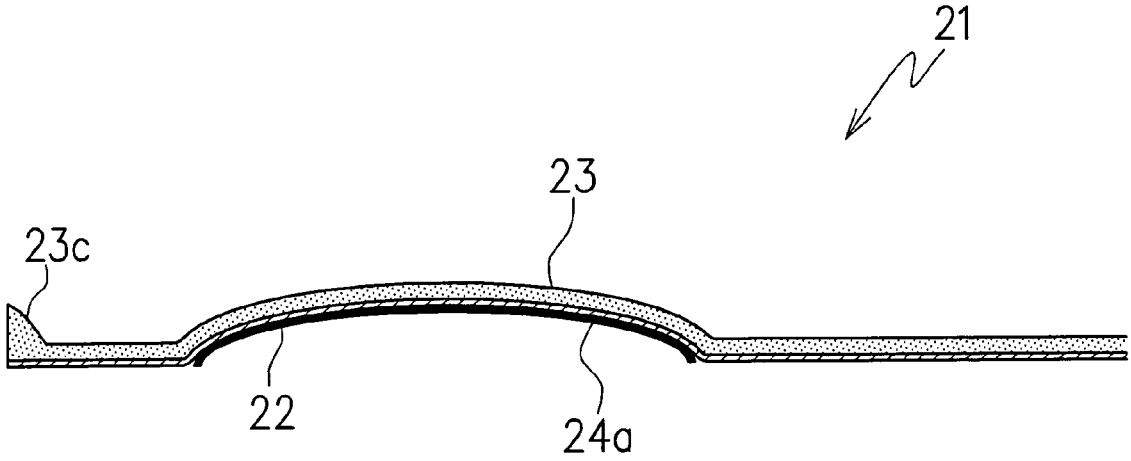
FIG. 1 is a partial sectional view showing one embodiment of a sheet switch according to the present invention.
Figure 2:
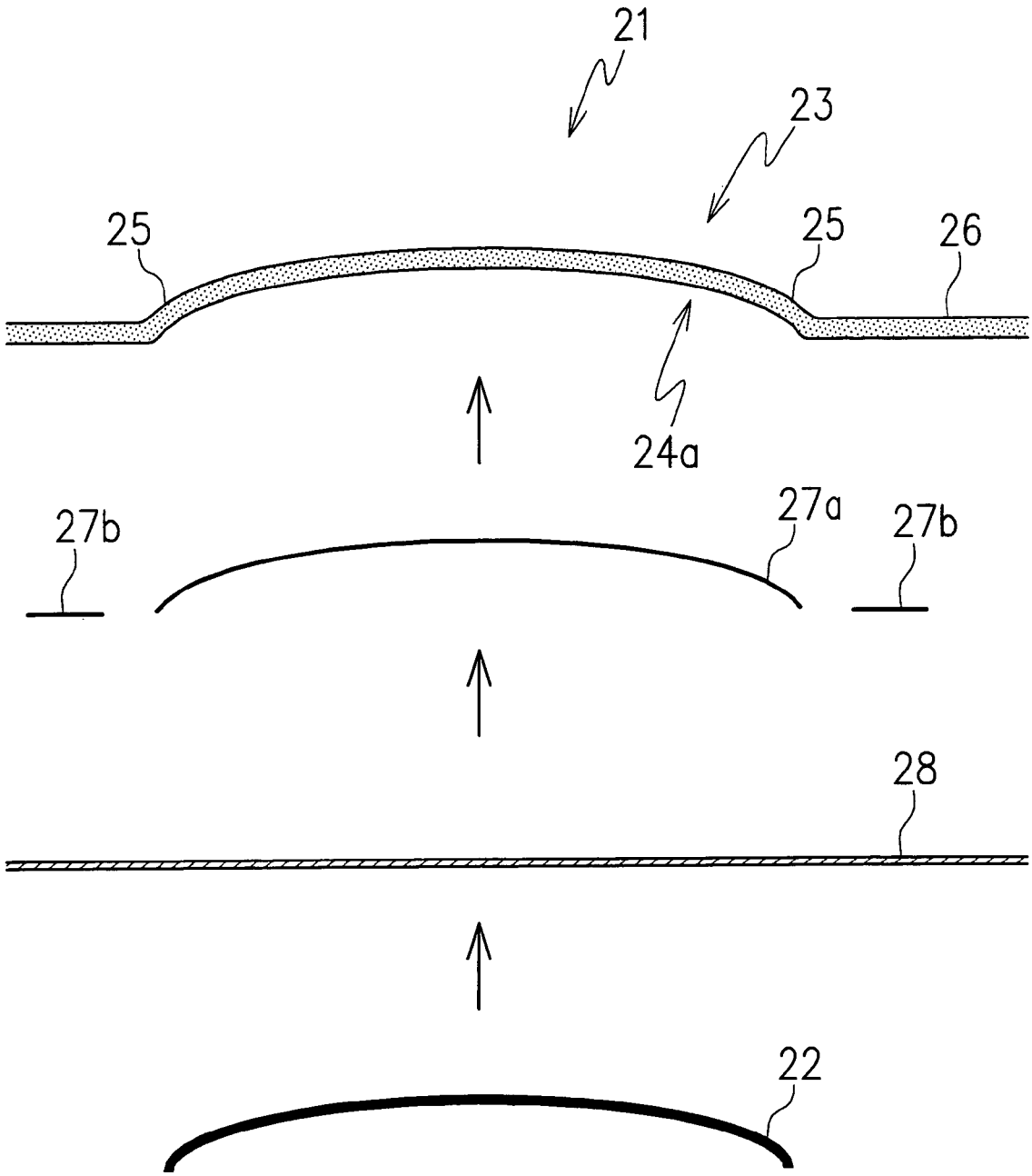
FIG. 2 is an exploded view of the sheet switch shown in FIG. 1.

As shown in FIGS. 1 and 2, the sheet switch 21 according to the present invention includes a spring 22 configured to enable electrical conduction between a central contact 32 (see FIG. 5) which is provided on, for example, a circuit board 33 and a circumferential contact 20 (see FIG. 6) which is disposed circumferentially of the central contact 32, and a transparent sheet member 23 configured to cover the spring 22. The circumferential contact 20 is provided on the circuit board 33 to form electric patterns in combination with the central contact 32.

The spring 22 is disposed on the circumferential contact to face the central contact 32 and configured to enable electrical conduction between the central contact 32 and the circumferential contact 20 when an upper surface of the spring is pressed. A plurality of pairs of central contacts 32, and a plurality of springs 22 may be provided.

Figure 5:
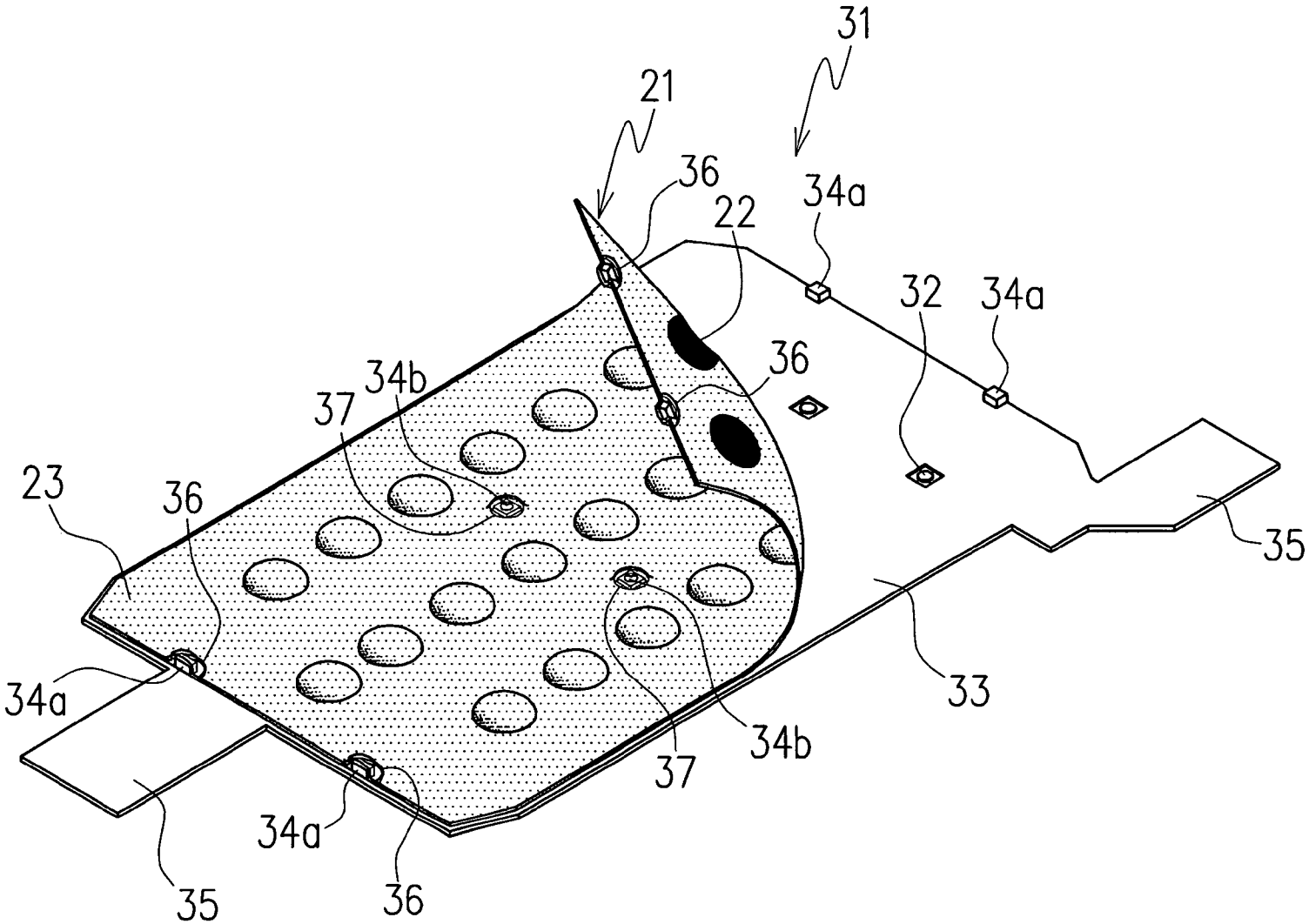
FIG. 5 is a perspective view showing one embodiment of a sheet switch module according to the present invention.

In the sheet switch 21 in this embodiment, a plurality of pairs of central contacts 32 and springs 22 are provided to correspond to, for example, a plurality of push buttons of a mobile phone to form a plurality of key switches, as shown in FIG. 5.

Each of the springs 22 is made of, for example, a thin plate-like metallic material and is formed into a dome-like shape as shown in FIGS. 1 to 4. Each spring 22 may be formed by a tact spring having elasticity to give an adequate click sense when pressed. The sheet member 23 is formed by one sheet member disposed to cover, for example, the whole of the plurality of dome-like springs 22, as shown in FIG. 5.

The sheet member 23 is made of, for example, a resinous film with a light guiding property, which is closely attached to, for example, upper surfaces of the springs 22. The resinous film should preferably be made of a high-polymer material with a light guiding property and translucency such as polyimide, polycarbonate, polyethylene terephthalate, polypropylene, polyethylene, polystyrene, silicone or the like.

In addition, there is no particular limit on the thickness of the sheet member 23, but it should preferably be within a range of 0.05 mm to 0.3 mm. Taking account of light guiding efficiency and adhesiveness to the spring 22, a thickness of 0.1 mm, or thereabouts, is especially suitable.

As shown in FIG. 5, a sheet switch module 31 to which the above-mentioned sheet switch 21 is applied includes an illumination structure to illuminate at least a position of the spring 22. The illumination structure has a light source to supply light to the sheet member 23. The light source includes, for example, a plurality of light emitting diodes (hereinafter, referred to as LEDs) 34*a* and 34*b* disposed on the circuit board 33 to input light from opposite edges and a central portion of the sheet member 23 into the sheet member 23 (see FIG. 5).

In this case, for ready introduction of the light emitted from the LEDs into the sheet member 23, it is preferable for an incident portion 23*c* having a certain thickness to be provided extending along the opposite edges of the sheet member 23 to face the LEDs 34*a* (see FIG. 1).

An emboss portion 24*a* should preferably be formed in advance on the sheet member 23 at a position corresponding to each of the domed springs 22. Each emboss portion 24*a* is formed to correspond to an external shape of the spring 22. The emboss portion 24*a* is formed in such a manner that an outer circumferential portion of the emboss portion has a raised portion 25 rising up smoothly from a flat portion 26 of the sheet member 23 (see FIG. 2).

The raised portion 25 has, when light emitted from the LEDs is introduced in the sheet member 23 as described hereinafter, a function of making it easy to change a course of the light so that the light is transmitted smoothly from the flat portion 26 to the raised portion disposed along the domed spring 22.

The sheet switch 21 includes a plurality of light reflection sections 27*a* and 27*b* provided in each of the above-mentioned emboss portions 24*a* of the sheet member 23 and on one portion of a back surface of the flat portion 26 of the sheet member 23, as shorn in FIG. 2. Each of the light reflection sections 27*a* and 27*b* is formed by a reflection sheet or reflection film which is closely attached to an inner surface of each of the emboss portions 24*a* of the sheet member 23 and the flat portion 26 trough a two-sided adhesive sheet 28.

The two-sided adhesive sheet 28 acts to attach the springs 22 to the sheet member 23 and the light reflection sections 27*a* and 27*b* and fix the sheet member 23, the light reflection sections 27*a* and 27*b* and the springs 22 to the circuit board 33. It should be mentioned that it is also possible to mount a flat sheet member directly on the springs 22 and closely fit the sheet member to an external shape of each of the springs 22 by heating and pressing and so on, without making previous provision of the above-mentioned emboss portions 24*a* on the sheet member 23.

The light reflection sections 27*a* and 27*b* are provided to further enhance reflection efficiency at the springs 22. In this embodiment, the light reflection sections 27*a* and 27*b* are formed by a reflection sheet or painted-on reflection film with a high reflection efficiency such as a white-type material, silver or the like which is attached to the back surface of the sheet member 23. Each light reflection section 27*a* is provided mainly in a place corresponding to a position of the spring 22, and each light reflection section 27*b* is provided on one portion of the flat portion 26 other than the portion corresponding to the spring 22, if needed. There are no limits on the shapes or arrangements of the light reflection sections 27*a* and 27*b* and each of the light reflection sections is arranged for convenience depending on a shape, size or arrangement of the springs 22.

Figure 3:
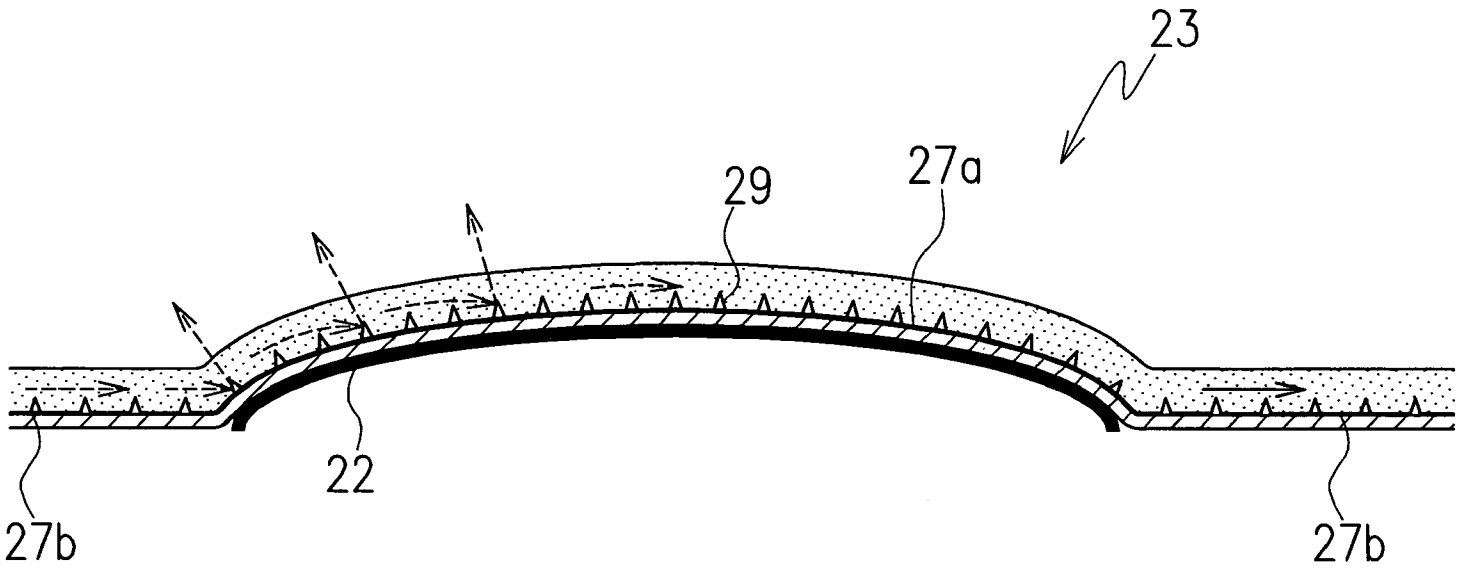
FIG. 3 is a partial sectional view of the sheet switch in which a plurality of concave and convex portions used to reflect light are provided on a back surface of sheet member.

Instead of the light reflection sections 27*a* and 27*b* with the above-mentioned structure, concave and convex portions 29 may be provided on the back surface of the sheet member 23, as shown in FIG. 3. By providing the concave and convex portions 29 continuously on the sheet member 23 on the inside of which each of the springs 22 is positioned, the course of a part of the light which passes trough the sheet member 23 is changed, as mentioned hereinafter. Therefore, a great deal of light can be directed to the area above the springs 22.

The concave and convex portions 29 are formed on the inside or back surface of the sheet member 23 which faces the springs. When the sheet member 23 is formed, a die may be used to form a concave and convex surface or the surface may be polished with a file or the like. By providing such concave and convex portions 29 to overlap with the places where the light reflection sections 27*a* and 27*b* formed by the reflection sheet or painted-on reflecting film are disposed, it is possible to illuminate the places where the springs 22 are disposed and at least a portion of the vicinity of each of those places with even greater brightness by the action of light reflection and upward direction of the light path.

It is also possible to adjust emission brightness or emission range at the position of each of the springs 22 on the sheet member 23 and at peripheral positions by suitably setting a shape or depth of each of the concave and convex portions 29.

Figure 4:
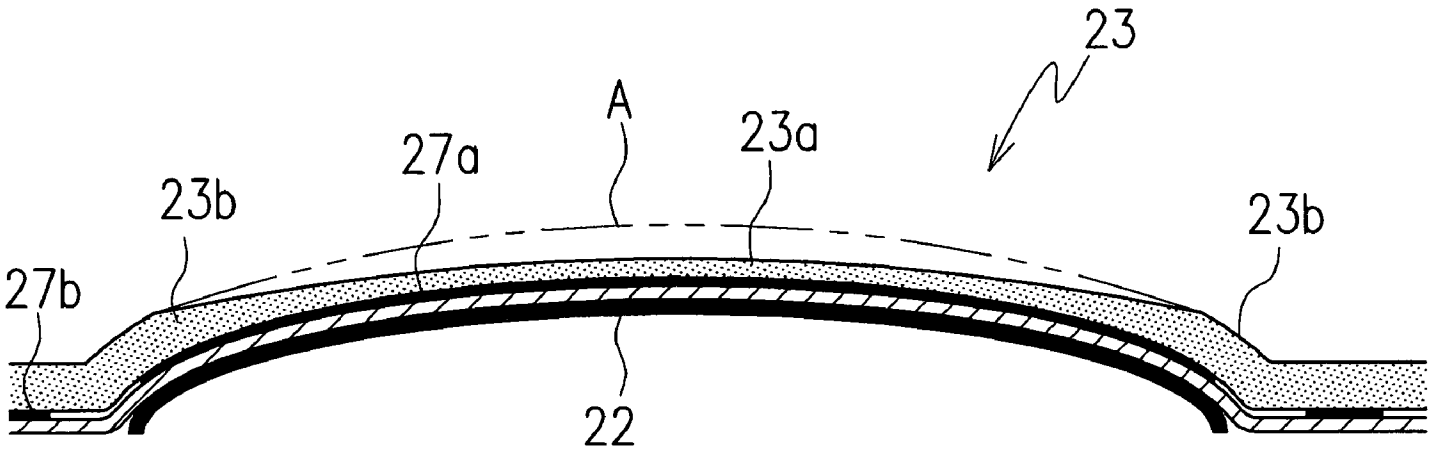
FIG. 4 is a sectional view showing the sheet switch in which a thickness of the sheet member is partially changed.

FIG. 4 illustrates a sheet switch formed with partial changes in thickness of the sheet member at portions corresponding to where each of the springs 22 is disposed.

In this embodiment, a central portion 23*a* of the sheet member 23 facing each spring 22 is formed with a thickness less than that of a peripheral edge portion 23*b* of the sheet member corresponding to a circumferential portion of the spring 22, as shown by the two-dot chain line A in FIG. 4. Gradually reducing the thickness of the sheet member from the peripheral edge portion 23*b* to the central portion 23*a* in this way allows a part of the light passing through the sheet member 23 to be refracted or reflected toward an upper part of the spring 22. It is therefore possible to brighten the sheet member 23 particularly at portions corresponding to where the springs 22 are disposed.

In addition, the provision of the concave and convex portions 29 on the inside or back surface of each portion corresponding to each of the springs 22 results in the area above each spring 22 being illuminated with even brightness. By thinning the central portion 23*a* of the sheet member facing each spring 22, it is possible to further enhance the clicking sensation effect when the spring is pressed.

In the sheet switch module 31 as shown in FIG. 5, the plurality of central contacts 32, the LEDs 34*a* and 34*b* and other connector areas 35 for connecting to a motherboard of an external instrument such as a mobile phone are provided on the circuit board 33. The circuit board 33 may be formed by a flexible printed circuit board (FPC).

If the sheet switch module 31 is structured to be used as, for example, a sheet switch of an operational panel of a mobile phone, the circuit board 33 is formed to be generally similar in shape and size to the operational panel, and a plurality of central contacts 32 are provided at positions of the circuit board corresponding to places where numeric keys, alphabet keys and other functional keys and so on are disposed. The LEDs 34*a* and 34*b* are disposed at the opposite edges and central portion of the circuit board 33, as mentioned above. The sheet member 23 of the sheet switch 21 is provided with cutouts 36 and holes 37 at positions where the LEDs 34*a* and 34*b* are disposed.

As shown in FIG. 5, side surface emission-type LEDs 34*a* are disposed at the opposite edges of the circuit board 33 and upper surface emission-type LEDs 34*b* are disposed at the central portion of the circuit board 33, respectively. The number of LEDs and the places where those LEDs are disposed are set appropriately in accordance with a shape and size of the circuit board 33 and the number of each of the central contacts 32 and the springs 22. For example, in the case of the rectangular sheet switch 21 as shown in FIG. 5, in which numeric keys and cross-functional keys ale disposed as in a mobile phone, it is preferable for two LEDs to be disposed in two places on each of the opposite edges of the circuit board 33 and two LEDs to be disposed in two places on the central portion of the circuit board 33.

A second embodiment of the sheet switch module 31 according to the present invention is shown, with reference to FIGS. 6 to 9.

It should be noted that in several of the embodiments described hereinafter, identical reference numbers are attached to parts which are the same as those in the above-mentioned first embodiment.

The sheet switch module 31 in the second embodiment includes one or mole switch portions. Each of the switch portions includes electrode patterns having at least one central contact 32 disposed on one surface, for example, an upper surface of a circuit board 33 and at least one circumferential contact 20 disposed circumferentially of the central contact 32, and a spring 22 disposed on the circumferential contact over the central contact 32. In addition, connectors and so on (not shown) are provided on the circuit board 33. The circuit board 33 comprises a flexible printed circuit board (FPC) similar to that in the first embodiment.

Each of the springs 22 has an outer peripheral edge which is disposed to be in contact with the circumferential contact 20 on the circuit board 33. The spring 22 is covered by a sheet member which is, for example, a light guiding sheet 30 in this embodiment.

When the circuit board 33 is used as, for example, a sheet switch of an operational panel of a mobile phone, it is formed to be generally similar in shape and size to the operational panel. Moreover, a plurality of central contacts 32 are provided to correspond to the places where numeric keys, alphabet keys, other functional keys and so on are disposed. In addition, in one example, a mirror-like finish is formed on an upper surface of each of the springs 22 to achieve a high reflection effect, and it is thereby possible to efficiently reflect to light guided by the light adding sheet 30 from the LEDs 34.

The light guiding sheet 30 is formed by a transparent or semi-transparent thinned sheet member having generally the same shape and size as the circuit board 33. It is preferable that the light guiding sheet 30 be formed by, for example, a material with a high light guiding property such as acrylic resin, silicon resin, polycarbonate resin or polyethylene terephthalate resin or the like. A thickness of the light guiding sheet 30 should preferably be set similar to that in the first embodiment.

It is preferable that the emboss portion 24*a* be provided in advance at parts of the light guiding sheet 30 corresponding to each of the springs 22, similarly to the first embodiment (see FIGS. 6 to 9).

When assembling the sheet switch 21 in practice, a transparent adhesive 45 is applied uniformly to the entire inside or back surface of the light guiding sheet 30 including the emboss portions 24*a*, the springs 22 are adhered to the adhesive surfaces at the emboss portions 24*a*, and the light guiding sheet 30 is adhered onto the circuit board 33 so that the springs 22 are aligned with the central contacts 32 on the circuit board 33, whereby covering the upper surface of the circuit board 33 with the light guiding sheet 30.

It should be noted that it is not necessarily required to provide the emboss portions 24*a* on the lights guiding sheet 30. In the case mentioned above, the springs 22 may be attached directly to a flat light guiding sheet using heating, pressurization or the like so that the back surface of the light guiding sheet 30 is closeted fitted to an external shape of each of the springs 22. Even in this case, a raised portion 25 rising up from a flat portion of the sheet member 23 is formed at a boundary between each spring 22 and the flat portion of the light guiding member 30, similarly to the first embodiment.

Figure 9:
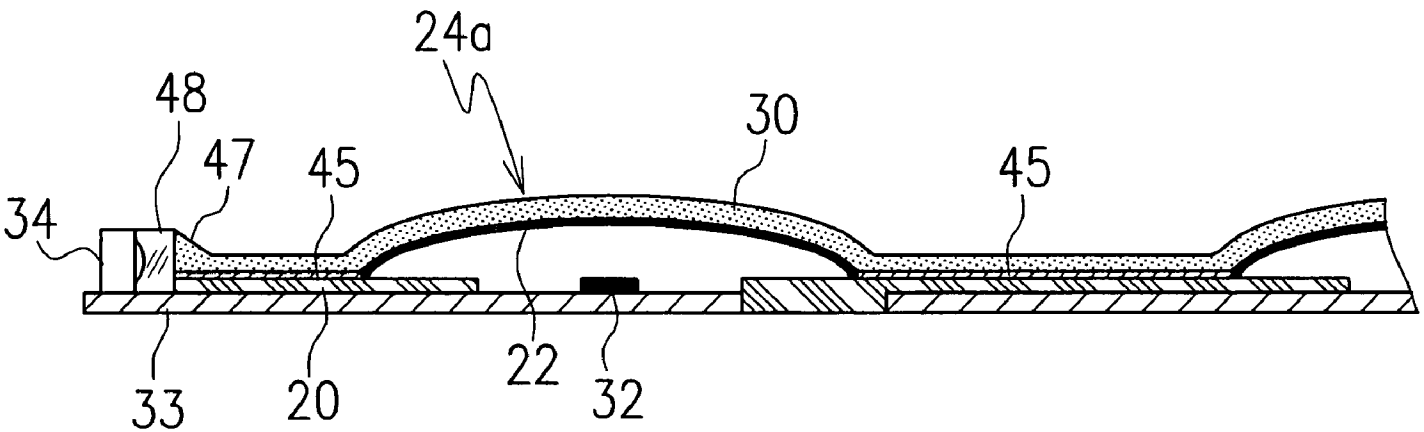
FIG. 9 is a sectional view showing an assembled state view of the sheet switch module shown in FIG. 6.

What is more, when the upper surface of the circuit board 33 is covered by the light guiding sheet 30, the emboss portions 24*a* may be closely fitted to the springs 22 directly without applying the adhesive 45 to the emboss portions 24*a* to allow the circuit board 33 to be covered by the light guiding sheet 30, as shown in FIG. 9. In this way, because the light guiding sheet 30 is closely fitted to the upper surfaces of the springs 22 directly without the adhesive 45, it is possible to eliminate absorption and attenuation of light by the adhesive 45 and therefore obtain a high reflection effect directing much of the light in an upward direction.

Figure 6:
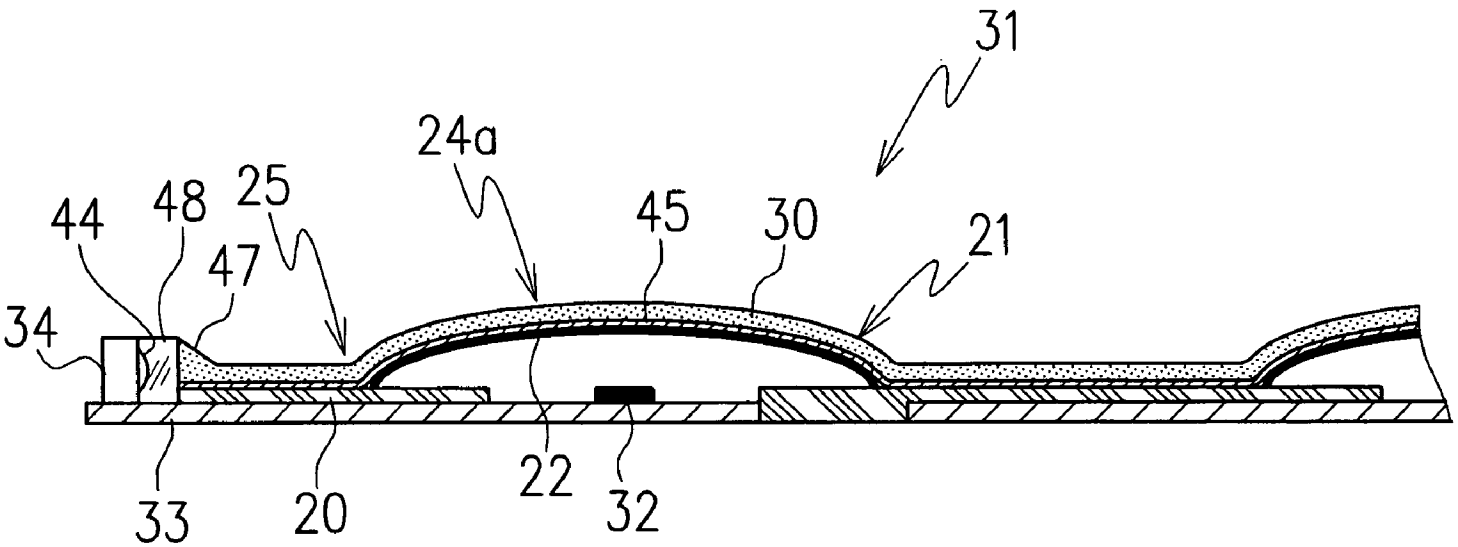
FIG. 6 is a sectional view showing another embodiment of a sheet switch module according to the present invention.
Figure 7:
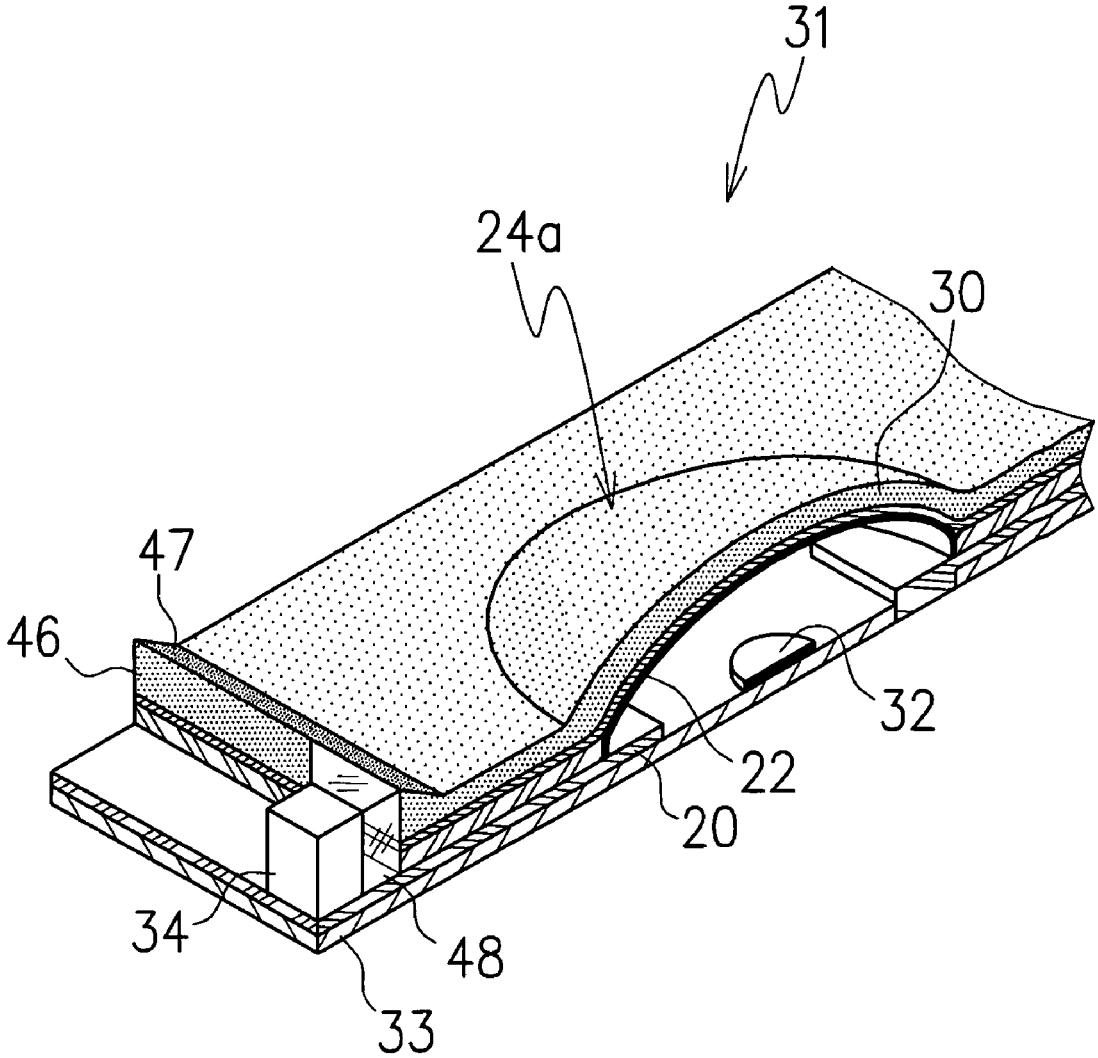
FIG. 7 is a partial perspective view of the sheet switch module shown in FIG. 6.
Figure 8:
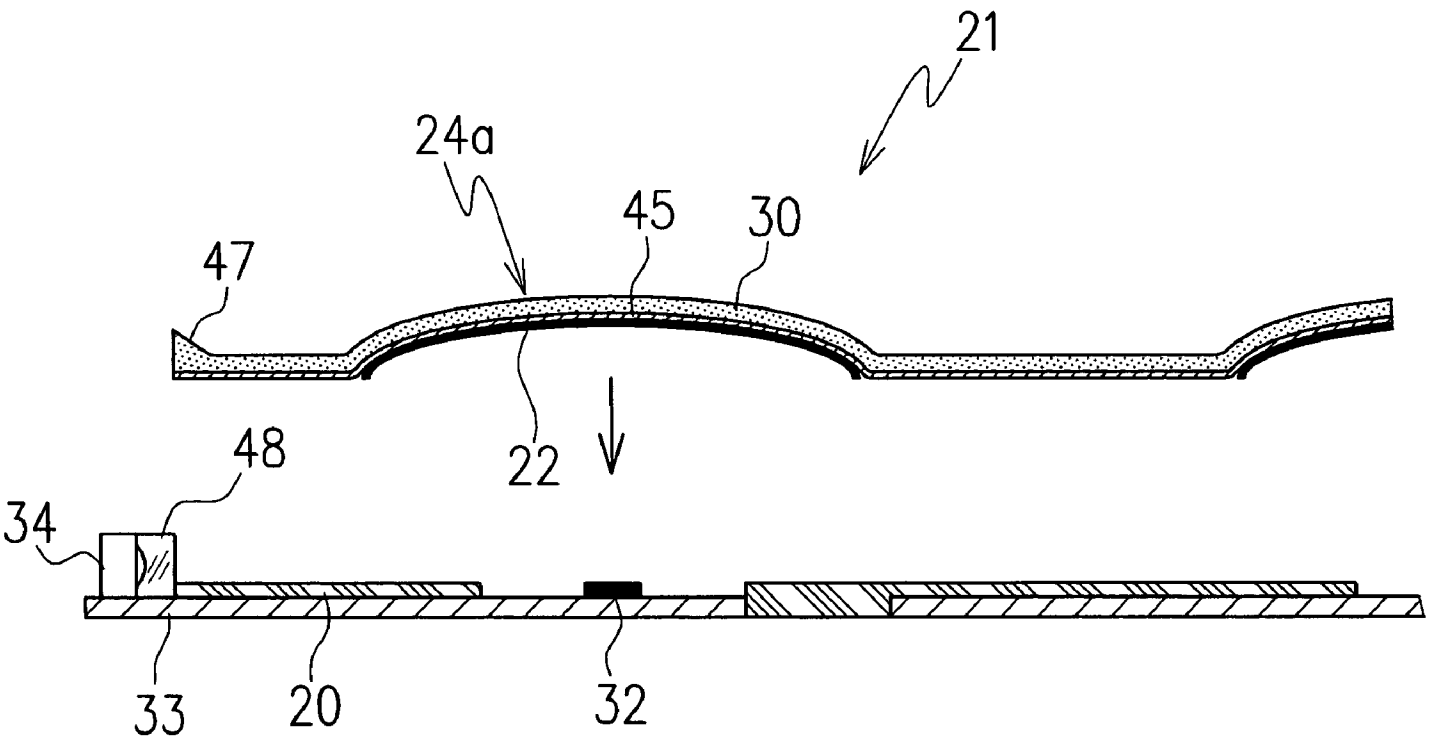
FIG. 8 is a sectional view showing an exploded state view of the sheet switch module shown in FIG. 6.

At least one LED 34 is used in the second embodiment (see FIG. 7). In this embodiment, the LED 34 comprises a side surface emission-type LED having an emission surface 44 (see FIG. 6). As shown in FIGS. 6 and 7 the LED 34 is disposed at an edge of the circuit board 33 in such a manner that the emission surface 44 is disposed to face an outer side surface 46 of the light guiding sheet 30. The number of LEDs and the places where those LEDs are disposed are set appropriately in accordance with a shape and size of the sheet switch module 31 and the number of each of the central contacts 32 and the springs 22 provided on the circuit board 33. For example, in the case of the rectangular sheet switch 21 in which numeric keys, functional keys and so on are disposed as in a mobile phone, a plurality of LEDs 34 are disposed to face sides of the light guiding sheet 30.

In this second embodiment, an incident portion 47 of the light guiding sheet 30 is provided to allow efficient introduction of light emitted from, the emission surface 44 of the LED 34 into the outer side surface 46 at the incident portion 47 without leakage, similarly to the first embodiment. The incident portion 47 comprises an increased thickness portion forming the outer side surface 46 of the light guiding sheet 30 and the outer side surface 46 faces and is aligned with the emission surface 44 of the LED 34. Furthermore, in this second embodiment, it is possible to prevent leakage when guiding the light emitted from the emission surface 44 to the incident portion 47 of the light guiding sheet 30, by filling and sealing a gap between the emission surface 44 of the LED 34 and the incident portion 47 at the outer side surface 46 of the light guiding sheet 30 with a transparent resin 48.

It is preferable to use a resinous material similar to that of the light guiding sheet 30 for the transparent resin 48, but there is no particular limit on a shape for sealing the gap. It should be noted that the LEDs 34 may be disposed not only on the opposite sides of the circuit board 33, as mentioned above, but also circumferentially of each spring 22. In this case, upper surface emission-type LEDs are used to uniformly illuminate the circumference of each spring 22.

Figure 10:
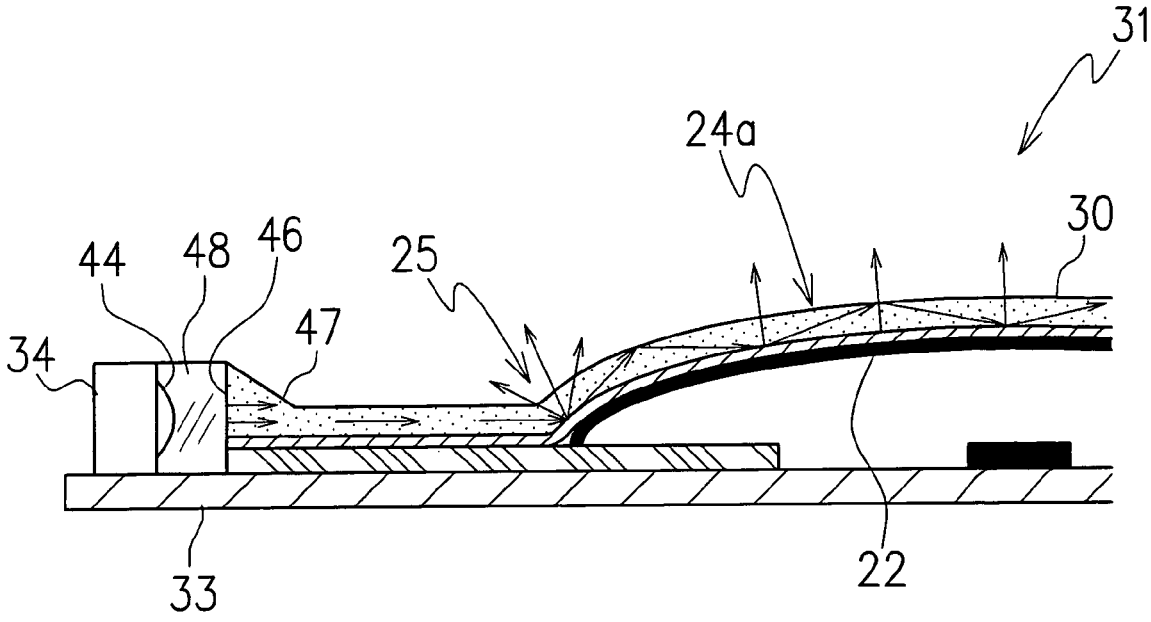
FIG. 10 is a partial sectional view showing the light emission process of a light guiding sheet in the sheet switch module shown in FIG. 6.

Next, operation of the sheet switch module 31 with the above-mentioned structure is explained referring to FIG. 10.

A current supplied from a mother board (not shown) is applied to the LEDs 34 through a connector (not shown) provided on the circuit board 33. The light emitted from the emission surface 44 of the LEDs 34 enters the light guiding sheet 30 through the transparent resin 48 and the outer side surface 46 at the incident portion of the light guiding sheet 30.

The light enters and is guided in the light guiding sheet 30 in a direction parallel to a surface of the circuit board 33.

The light which reaches the raised portion 25 forming the emboss portion 24*a* is reflected on the raised portion 25 and undergoes a rapid changes in its course. A part of the reflected light goes in the light guiding sheet 30 along the upper surface of each of the springs 22 while undergoing repeated reflection, as shown in FIG. 10. Because the springs 22 are made of a metallic material, it is possible to achieve improved efficiency of light reflection over the entire upper surfaces of the springs to gather scattered light reflected on the upper surfaces of the springs and direct it upwardly to the area above the springs in all directions. In this way, because the light guiding sheet 30 is closely fitted to the springs 22 along the external shape thereof, it is possible to illuminate the area above the springs 22 which are the parts of keys to be depressed during operation with high brightness and without any variations in intensity of the light emitted from the LEDs 34.

As mentioned above, improved reflection efficiency and a high level of brightness can be achieved by providing a mirror-surface finish, microscopic concave and convex portions, or a textured finish on the upper surface of each of the springs 22 with which the light guiding sheet 30 is closely fitted. It should be noted that the springs 22 are not limited to being made of metallic material. For example, it is also possible to provide each of the springs by emboss-processing a flexible resinous plate into a dome-like shape as a spring and attaching an electrode to provide electrical conduction between the central contact 32 and the circumferential contact 20 to an inside or back surface of the dome-like shape. Also, it is possible to apply a metallic film by plating, or evaporation, or painting a coating material containing fine metallic or glass particles with reflection effects, to the upper surface of each spring.

Forming each spring by the resinous plate with the above-mentioned structure allows the entire spring to achieve a soft clicking sensation different from that of a metallic spring.

In addition, to direct the light efficiently into the light guiding sheet 30 and toward the area above the springs 22, a structure is proposed, in which a light reflection member or light scattering part is provided on the inside or back surface, or outside or front surface of the light guiding sheet 30.

For example, by applying a light reflection member comprising a coating material of white or silver to the back surface of the light guiding sheet 30, it is possible to illuminate the area above the springs 22 concentrically without the light being absorbed by the circuit board 33. Also, providing a light scattering part having a plurality of concave and convex portions on an upper surface of the light guiding sheet 30 allows the light guided in the light guiding sheet 30 to be emitted toward the area above the springs while undergoing scattering. The light scattering part can be easily formed by using a die to apply a textured finish or the like to the light guiding sheet 30 during manufacture.

It should be noted that in the sheet switch module 31 in this embodiment, by providing letters or marks or the like on the light guiding sheet at the springs 22 for representing various switch operations, the sheet switch module can be used as is, for a keypad of a mobile phone, etc. Alternatively, by providing a coating material with a shielding property or a thin shielding member on any surface of the light guiding sheet other than portions corresponding to each spring, it is possible to brightly illuminate the area above the springs 22, in particular.

Figure 11:
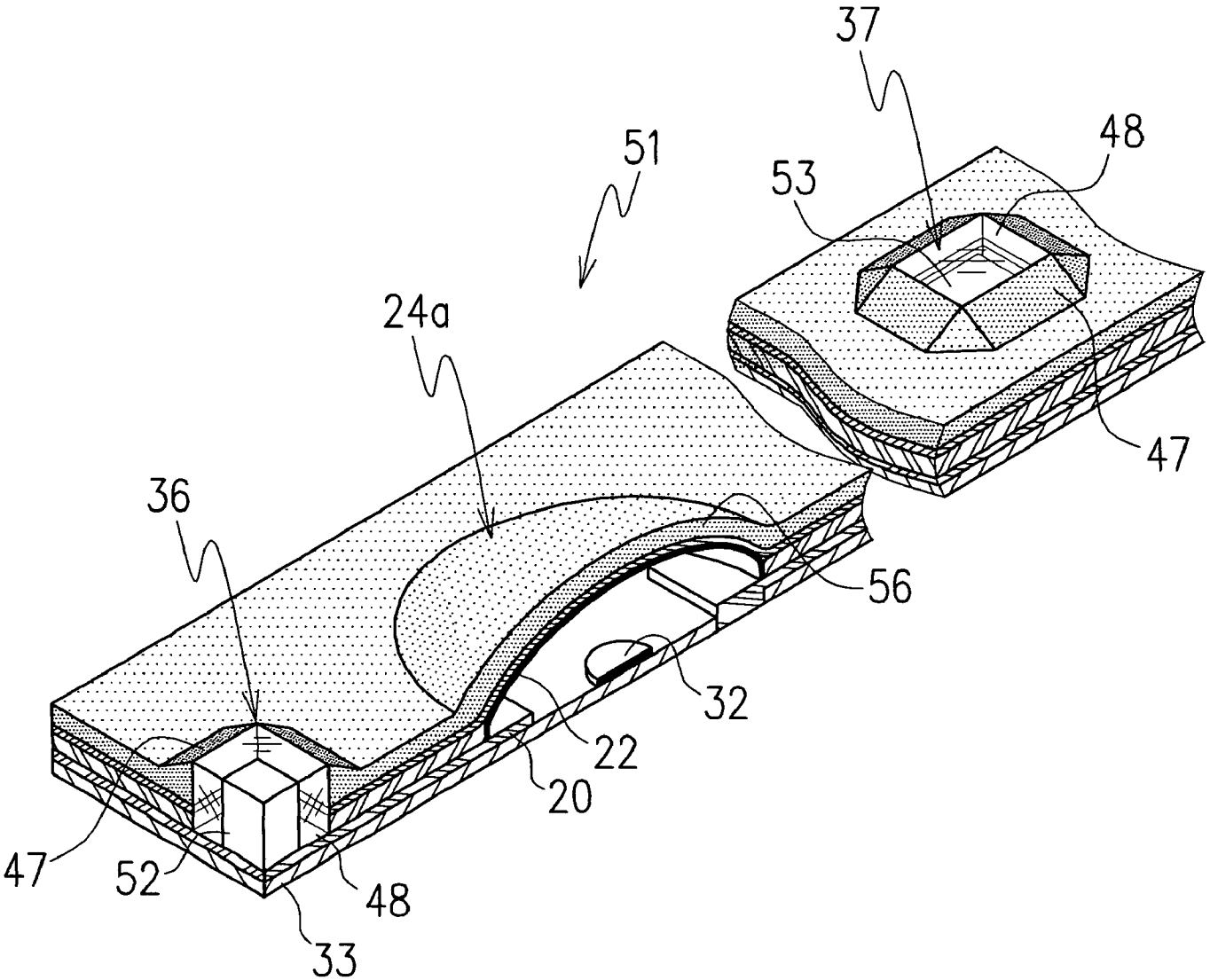
FIG. 11 is a partially broken perspective view of the sheet switch showing another arrangement of LEDs in the sheet switch module shown in FIG. 6.

FIG. 11 illustrates a third embodiment of the sheet switch module according to the present invention.

The sheet switch module 51 in this embodiment has a structure in which at least one LED 52 is disposed at an end portion of a light guiding sheet 56 and one or more LEDs 53 are disposed at places other than the end portion of the light guiding sheet 56 to achieve an increased intensity of light.

The sheet switch module 51 includes concave portions provided in the light guiding sheet 56 for containing the LEDs 52 and 53. The concave portions are formed by a cutout 36 (see FIG. 11) provided in end portions of the light guiding sheet 56 and a hole 37 (see FIG. 17) provided in parts of the light guiding sheet other than the end portions. A side surface emission-type LED is used for the LED 52 disposed in the cutout 36, and an upper surface emission-type LED is used for the LED 53 disposed in the hole 37 to emit equally in all directions. Moreover, filling in a gap between an inner peripheral surface of the cutout or su faces inside the hole and the LED with the transparent resin 48 can achieve increased emission efficiency in the light guiding sheet 56.

Furthermore, provision of an inclined incident portion 47 on the light guiding sheet 56 set to match the height of the LEDs 52 and 53 allows light emitted from the LEDs 52 and 53 to be guided in the light guiding sheet 56 without leakage.

Because a structure of a central contact 32, a circumferential contact 20, a spring 22, an emboss portion 24*a* and so on is the same as in the above-mentioned sheet switch module 31, a description thereof is omitted.

Figure 12:
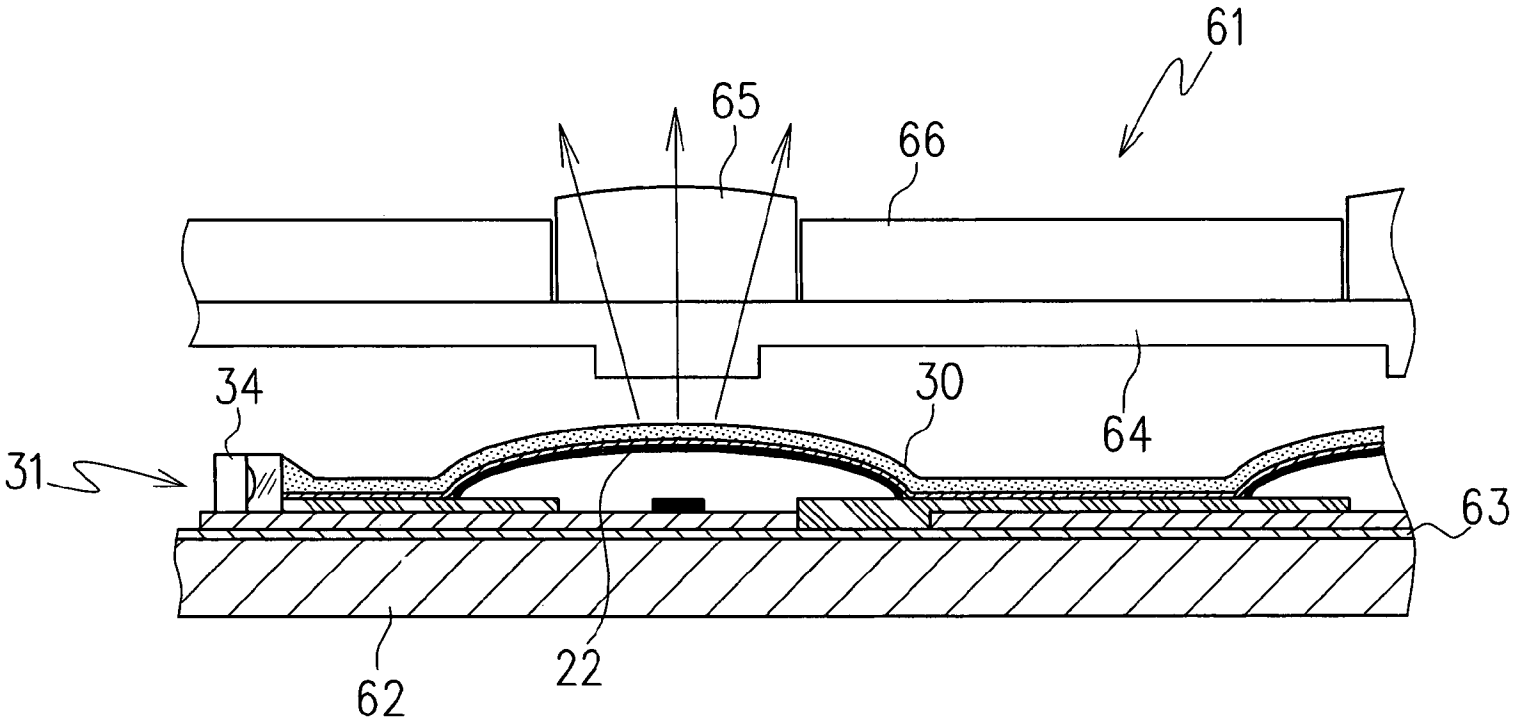
FIG. 12 is a sectional view showing one example with an operational panel in which the sheet switch module shown in FIG. 6 is installed.

FIG. 12 illustrates a first embodiment of a flat-type panel switch 61 in which the sheet switch module 31 in the second embodiment as shown in FIG. 6 is installed.

The panel switch 61 is configured such that the sheet switch module 31 is mounted on a substrate 62 of a device such as a mother board or the like through a two-sided adhesive tape 63.

The panel switch 61 includes a rubber sheet 64 which is disposed above the sheet switch module 31 and has a light guiding property, and a surface sheet 66 which is disposed on the rubber sheet 64 and in which a plurality of key tops 65 with a light guiding property are provided (see FIG. 12).

The rubber sheet 64 is set to be generally the same size as the circuit board 33, and portions of the rubber sheet corresponding to at least the key tops 65 are transparent or translucent. Moreover, a portion of the rubber sheet corresponding to each of the springs 22 comprises a portion for pressing which is slightly increased in thickness (see FIG. 12). The rubber sheet 64 is disposed in parallel to the sheet switch 21 so that the portion for pressing is in contact with the part of the top surface of the light guiding sheet 30 corresponding to the spring 22. To dispose the rubber sheet 64 in a stable manner relative to the sheet switch module 31, a level of the rubber sheet 64 may be adjusted by inserting a spacer (not shown) between the rubber sheet 64 and the sheet switch module 31.

The surface sheet 66 constitutes a display surface of an operational panel provided in an electronic instrument in which the sheet switch module 31 is mounted and the surface sheet 66 is generally made of a soft resin such as rubber or the like; portions of the surface sheet corresponding to each of the springs 22 are adapted to form the key top 65 which is increased in thickness (see FIG. 12).

The surface sheet 66 is disposed to cover the area above the rubber sheet 64. Each of the key tops 65 has a light guiding property and a surface on which various letters or marks or the like may be formed in a concave and convex state or printed state. Each portion of the surface sheet excepting the key tops 65 is covered by a shielding member which does not allow light to pass. In addition, an improved light guiding effect within the light guiding sheet 30 can be achieved by formation of a metallic film on an inside or back surface of the shielding member.

The light emitted from the LEDs 34*a* and 34*b* of the sheet switch module 31 is guided to all parts of the light guiding sheet 30. If the springs are made of metal, light which has been guided to a portion of the light guiding sheet corresponding to each spring is reflected upwardly on the metallic spring 22. The reflected light, which passes through the rubber sheet 64 and enters the key top 65, provides bright illumination to an upper surface or operational surface of the key top 65.

As mentioned above, because the light guiding sheet 30 is closely fitted with the surface of each dome-like spring, the light guided to the spring is not leaked away from the spring, and most light can be reflected on the spring toward the key top 65, allowing the area above the spring to be illuminated with a high degree of brightness.

FIGS. 13 to 17 show a fourth embodiment of the sheet switch module according to the present invention.

Figure 13:
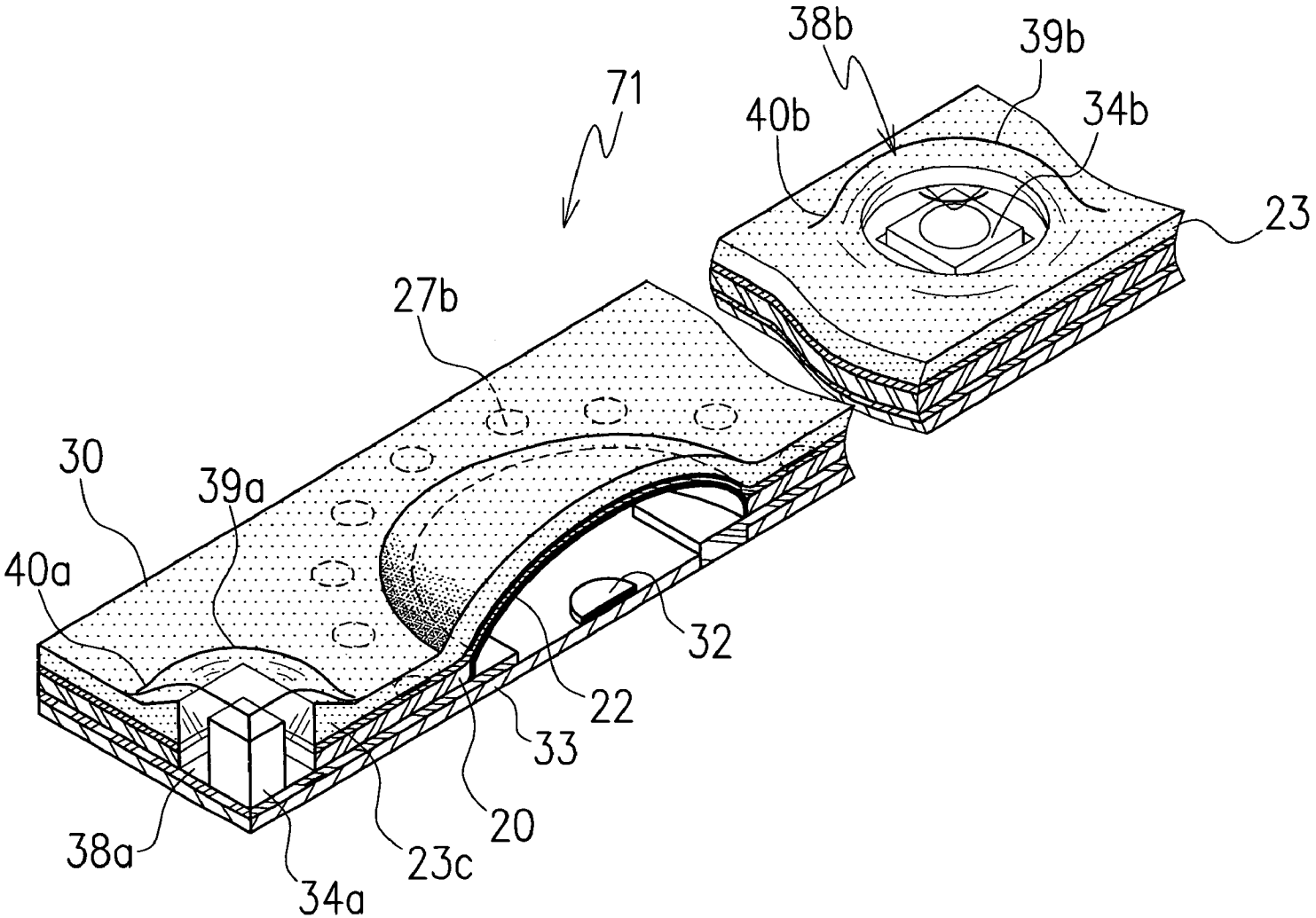
FIG. 13 is a partially broken perspective view showing an inner structure of still another embodiment of the sheet switch module according to the present invention.
Figure 14:
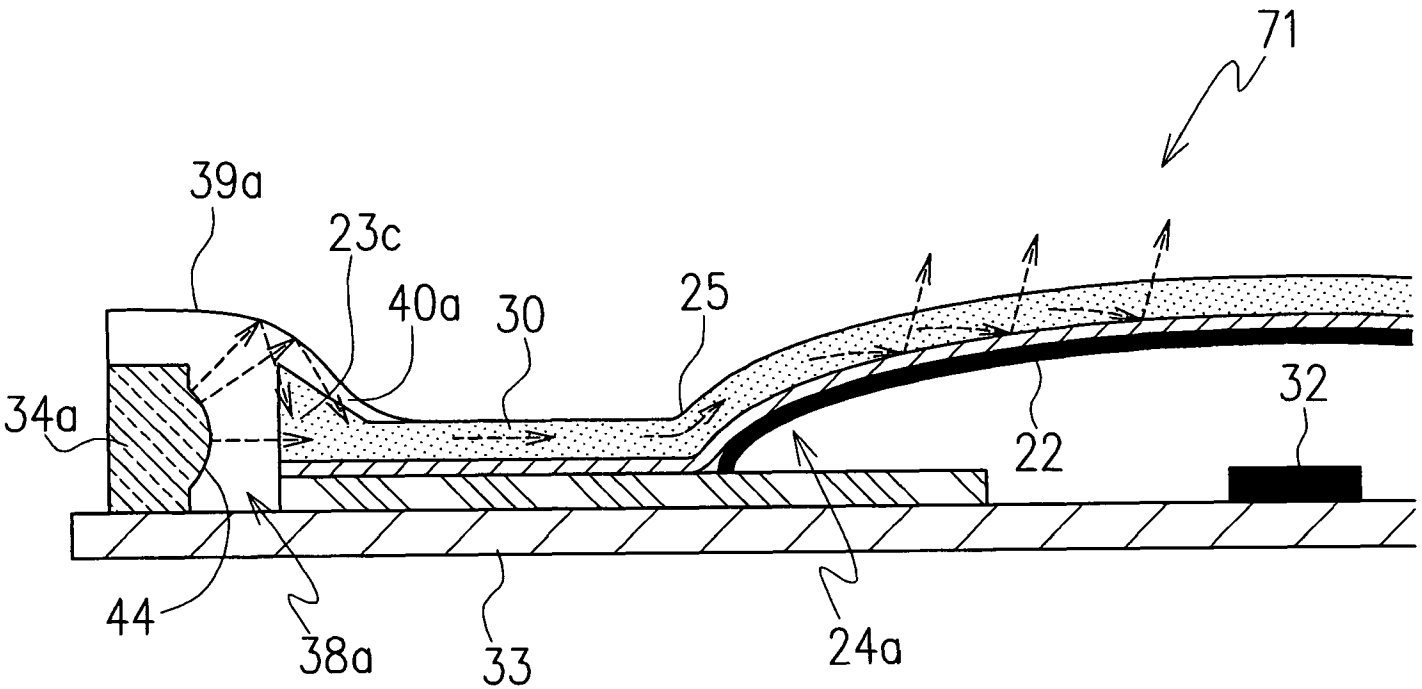
FIG. 14 is a partial sectional view showing yet another embodiment of the sheet switch module in which the LEDs are covered by the light focusing member.
Figure 17:
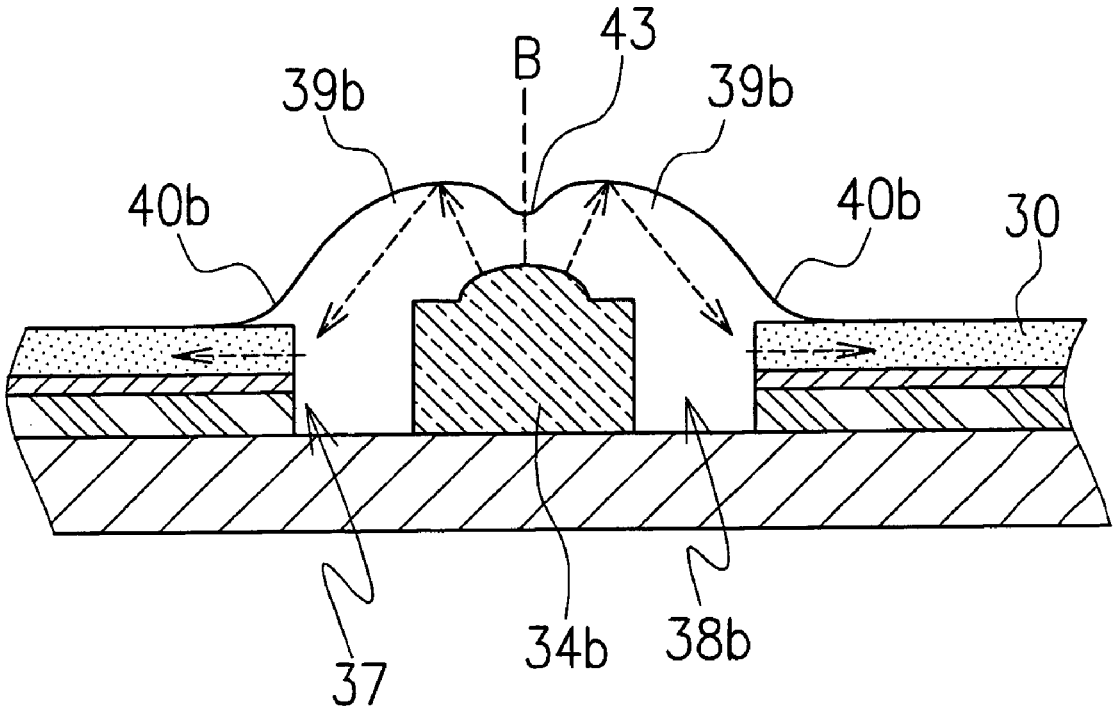
FIG. 17 is a palatial sectional view of the sheet switch module in which the light focusing member is provided on the LED disposed on a central portion of a circuit board.

As mentioned above, because the cutout 36 and the hole 37 configured to contain the LEDs disposed on the circuit board 33 are provided respectively in the light guiding sheet 30, a slight gap sometimes arises between an outer circumferential surface of the LED 34*a* and an inner circumferential surface of the cutout 36, or between an outer circumferential surface of the LED 34*b* and all inner surface of the hole 37 surrounding the LED, when the sheet switch 21 is mounted on the circuit board 33, as shown in FIGS. 13, 14 and 17. Therefore, in the sheet switch module 71 shown in this fourth embodiment, light focusing members 38*a* and 38*b* with a light focusing action are disposed circumferentially of the LEDs 34*a* and 34*b*, respectively, to fill the gap.

It is preferable to use a resinous material which is similar in nature and has a similar light guiding property to the light guiding sheet 30, for the light focusing members 38*a* and 38*b*. For example, as shown in FIGS. 13, 14 and 17, the light focusing members 38*a* and 38*b* are integrally formed by resinous materials filling in the gaps around the LEDs 34*a* and 34*b*, lens-like inflated portions 39*a* and 39*b* which are configured to rise above the LEDs 34*a* and 34*b*, and reduced portions 40*a* and 40*b* connecting smoothly from the inflated portions 39*a* and 39*b* to the light guiding sheet 30. The provision of the light focusing members 38*a* and 38*b* allows the light to be dispersed circumferentially from the LEDs 34*a* and 34*b* and guided efficiently in the light guiding sheet 30 to achieve high brightness emission and electric power saving.

In addition, in this embodiment, a plurality of light reflection portions 27*b* are disposed circumferentially of the spring 22 to achieve decorative effects or emission effects emphasizing the outline of the spring 22 (see FIG. 13).

Here, electrode patterns include a circumferential contact 20 which is formed circumferentially of the central contact 32 of the circuit board 33, as shown in FIG. 13.

In particular, the light focusing member 38*a* is formed with an inflated portion 39*a* and a reduced portion 40*a* extending from an upper surface of the LED 34*a* through to an upper surface of the incident portion 23*c* to fill a gap arising between the LED, 34*a* and the light guiding sheet 30. The provision of the inflated portion 39*a* allows light which is scattered upwardly from the LED 34*a* to be focused and guided smoothly to the incident portion 23*c* by the reduced portion 40*a*.

Figure 15:
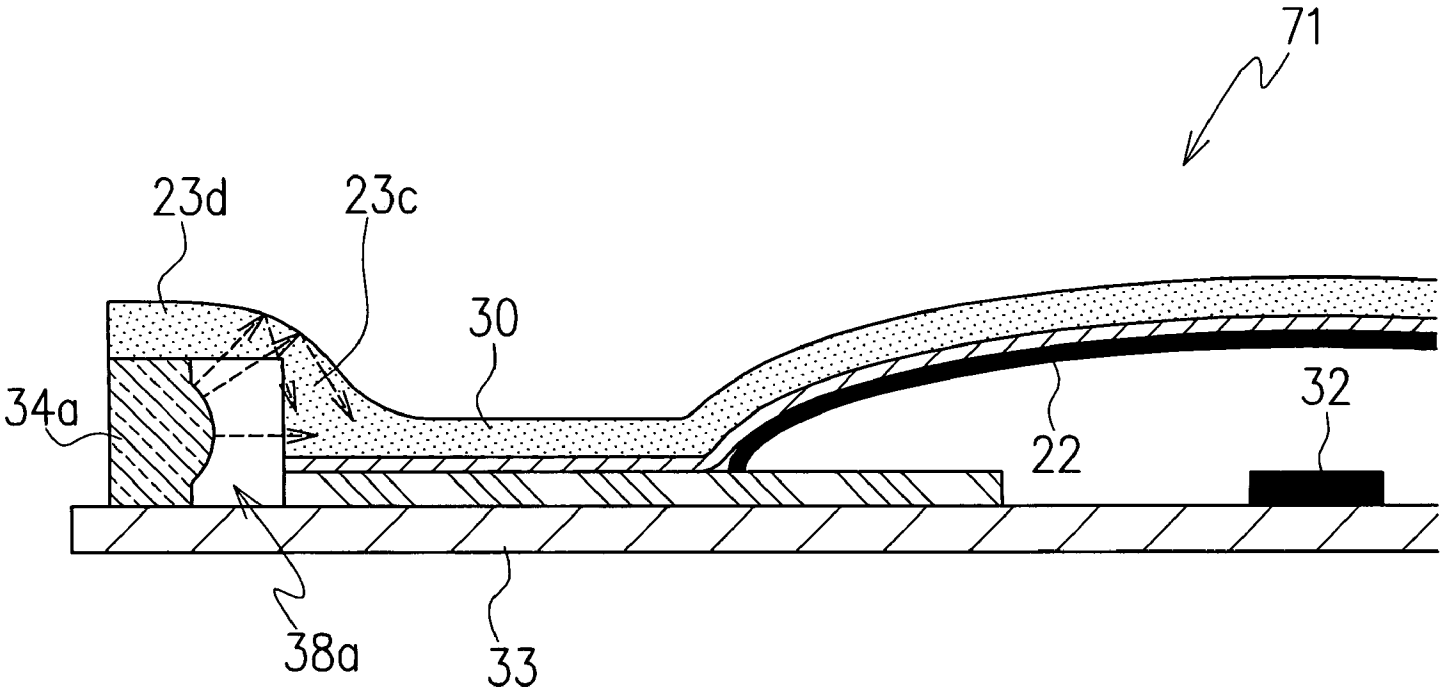
FIG. 15 is a partial sectional view of the sheet switch module on which an extension portion to cover the LED is formed.

As another form of the inflated portion 39*a* and the reduced portion 40*a*, an extension portion 23*d* is provided on the light guiding sheet 30 extending integrally from the incident portion 23*c* and disposed to cover an upper surface of each of the LED 34*a* and the light focusing member 38*a*, as shown in FIG. 15. By forming the light guiding sheet 30 in this way, it is possible to efficiently introduce the light emitted from the LED 34*a* into the light guiding sheet 30 and also have the same light focusing effects as with the inflated portion 39*a* shown in FIG. 14.

Figure 16:
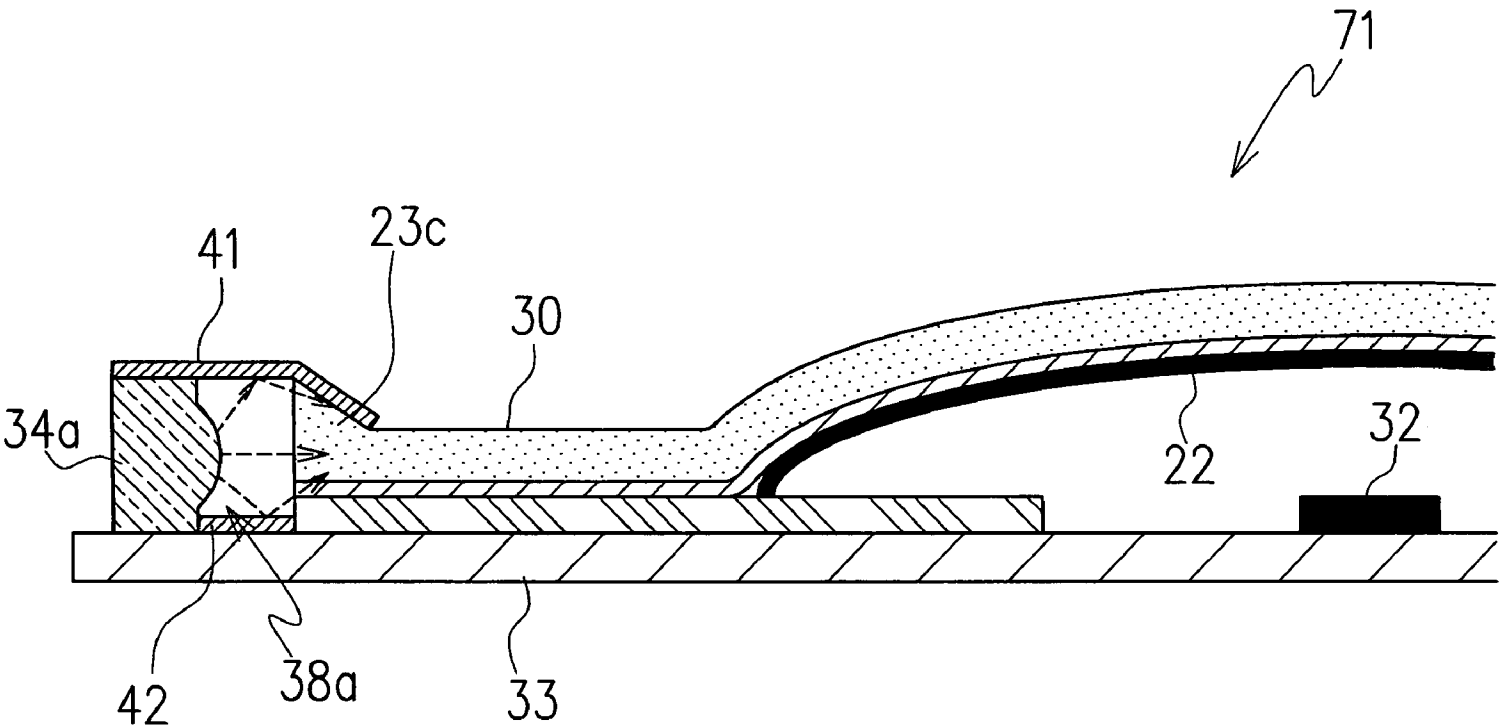
FIG. 16 is a partial sectional view of the sheet switch module in which the light focusing member is covered by a light reflection member.

FIG. 16 illustrates a structure in which after the light focusing member 38*a* is disposed in the gap between the LED 34*a* and the incident portion 23*c*, a light reflection member 41 to perfectly cover the upper surface of the light focusing member 38*a* is provided to extend throughout the upper surface of the LED 34*a* and one portion of the incident portion 23*c*, and another light reflection member 42 is provided between the circuit board 33 and a bottom surface of the light focusing member 38*a*. The light reflection members 41 and 42 are formed by a reflection sheet material or painted-on reflection film of white or silver type with a high reflection coefficient. The provision of the light reflection members 41 and 42 prevents light emitted from the LED 34*a* from being scattered to the circumference thus enhancing incident efficiency of light into the light guiding sheet 30.

In addition, because the light reflection member 41 has a property of shielding the passage of light to the exterior, the LEDs 34*a* and 34*b* are obscured and light is prevented from entering the eyes directly. By providing the light reflection member 41 on the upper surface of each of the inflated portion 39*a* and the reduced portion 40*a*, as shown in FIG. 14, and the upper surface of the extension portion 23*d* of the light guiding sheet 30, as shown in FIG. 15, leakage of light scattered upwardly from the LED 34*a* is securely prevented, and a high degree of light focusing effect toward the light guiding sheet 30 can be accomplished.

In addition, by providing the light reflection member 42 on the circuit board 33 on which the LED 34 is mounted, leakage of light from the circuit board 33 can be prevented, thus allowing a high degree of light focusing effect to be achieved.

As shown in FIGS. 5 and 13, because the LED 34*b* disposed on the central portion of the circuit board 33 uses an upper surface emission-type LED, the light emitted from the LED can be guided into the light guiding sheet 30 by covering an upper portion of the LED 34*b* which is exposed from the hole 37 with a light focusing member 38*b* made of a resinous material having a light guiding property (see FIG. 13). The light focusing member 38*b* provided to cover the LED 34*b* is preferably shaped to have a concave portion 43 disposed right above the LED 34*b* and on a central axis B of emission of the LED, inflated portions 39*b* disposed on opposite sides of the concave portion 43 and reduced portions 40*b* configured to extend from the inflated portions 39*b* to the light guiding sheet 30.

With the light focusing member 38*b* formed in this way, the light emitted from the LED 34*b* is focused upwardly by the inflated portions 39*b* to allow the light to be guided into the light guiding sheet 30 along the reduced portions 40*b*. By providing the light reflection member 41 upward of the light focusing member 38*b*, further light focusing effects are obtained and the LED 34*b* is obscured to prevent light from entering the eyes directly.

Next, illumination operation of the sheet switch module 71 with the abovementioned structure is described with reference to FIG. 14.

A current is supplied from a mother board or the like through a connector (not shown) mounted on the circuit board 33 to the LED 34*a*. The light emitted from an emission surface 44 of the LED 34*a* is introduced directly into the incident portion 23*c* of the light guiding sheet 30 through the light focusing member 38*a*. At that time, a part of the light scattered upwardly from the LED 34*a* is focused by the inflated portions 39*a* and guided by the reduced portions 40*a* to be introduced into the incident portion 23*c* of the light guiding sheet 30. In this way, the light guided into the light guiding sheet 30 comprises a combination of the direct light from the LED 34*a* and the light guided by the inflated portions 39*a* and the reduced portions 40*a*.

Light which reaches the raised portion 25 of the emboss portion 24*a* is guided along the upper, surface of the spring 22 while undergoing repeated reflection in the light guiding sheet 30. Because the spring 22 is made of a metallic material, it is possible to achieve a high reflection efficiency over the entire upper surface of the spring 22, and scattered, light is reflected upwardly to the area above the spring. In this way, because the light guiding sheet 30 is disposed to fit closely to the external shape of the spring 22, it is possible to illuminate the area above the spring 22 which is a part of a key to be depressed during operation with light emitted from the LED 34*a* with high brightness and without any variations in intensity.

As shown in FIGS. 2 and 3, because the reflection sheet material, painted-on reflection film, or the reflection sections 27*a* and 27*b* formed by the continuous concave and convex portions 29 are provided on the back surface of the light guiding sheet 30, it is possible to achieve a high reflection coefficient and a high level of brightness due to light scattering effects. It should be noted that the spring 22 is not limited to being made of metal. For example, it is also possible to form a spring by emboss-processing a flexible resinous plate into a dome-like shape as a tact spring and attaching an electrode to provide electrical conduction between the central contact 32 and the circumferential contact 20 to a back surface of the dome-like shape. Alternatively, it is possible to apply a metallic film for reflection by plating or evaporation, or to paint on a coating material containing fine metallic or glass particles with light reflection effects, on the surface of the spring 22. Forming the spring 22 by the resinous plate with the above-mentioned structure allows the entire spring to achieve a soft clicking sensation different from that of a metallic tact spring.

It should be noted that the above-mentioned sheet switch module 71 can be used directly as a section for pressing, by printing letters or marks or the like representing various switch operations on the light guiding sheet 30 covering the spring 22. Alternatively, by applying a coating material with a light shielding property or providing a thin shielding member on a part of a surface of the light guiding sheet 30 other than the place corresponding to the spring 22, it is possible to brightly illuminate the area above the sprig 22, in particular.

Figure 18:
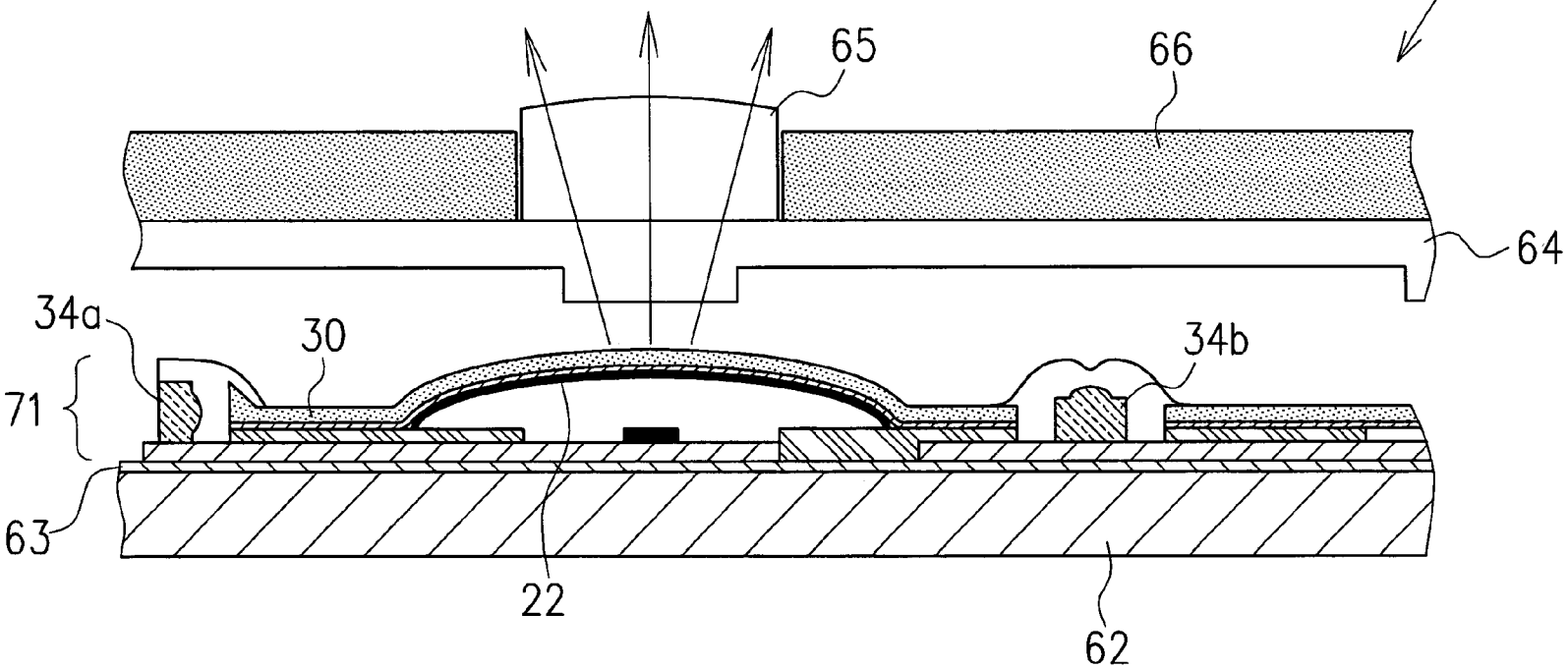
FIG. 18 is a partial sectional view showing one embodiment of a panel switch according to the present invention.
Figure 19:
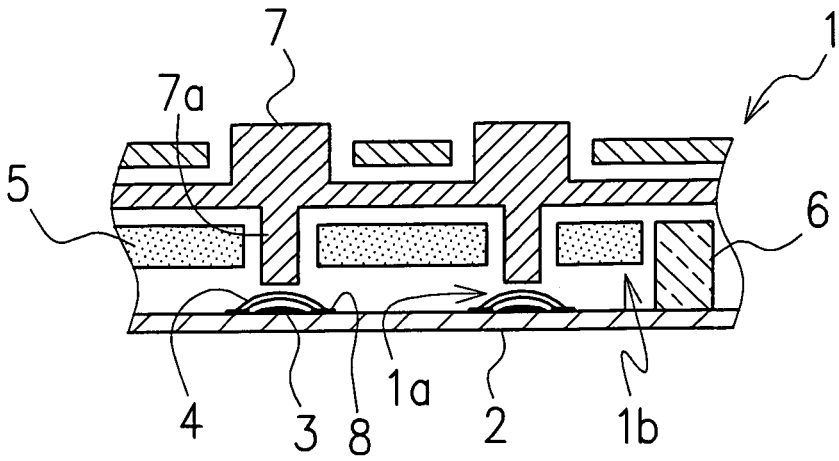
Fig. 19 (Prior Art)
FIG. 19 is a sectional view of a conventional illumination-type key switch.
Figure 20:
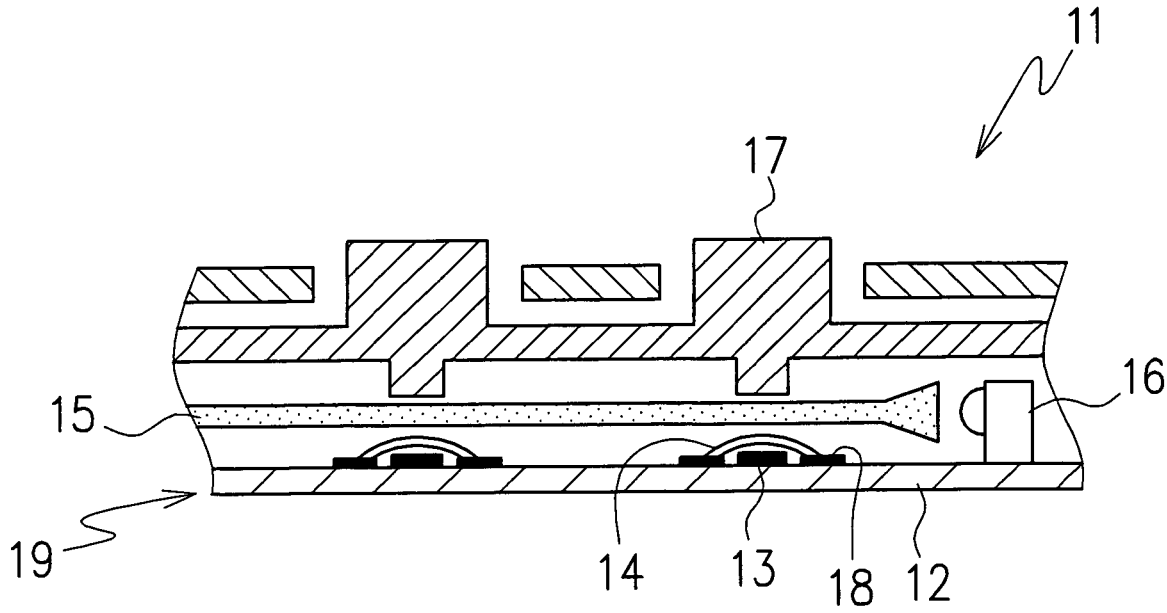
Fig. 20 (Prior Art)
FIG. 20 is a sectional view of another conventional illumination-type key switch.

FIG. 18 illustrates a second embodiment of a flat-type panel switch in which the sheet switch module 71 is installed.

The panel switch 81 has a structure in which the sheet switch module 71 is mounted on a substrate 62 of a device such as a mother board or the like through a two-sided adhesive tape 63, and includes a rubber sheet 64 with a light guiding property disposed above the sheet switch module 71 and a surface sheet 66 disposed on the rubber sheet 64. One or more key tops 65 with a light guiding property are provided at predetermined places on the surface sheet 66. The number of key tops 65 depends on the number of springs 22.

The rubber sheet 64 is set to be generally the same size as the sheet switch module 31. A portion of the rubber sheet 64 corresponding to at least the key top 65 is transparent or semi-transparent. A portion to be pressed constituting a part of the rubber sheet 64 coil responding to the spring 22 is formed to project slightly from a surface of the rubber sheet 64 (see FIG. 18). The rubber sheet 64 is disposed in parallel to the sheet switch module 71 so that the portion made up of the part to be pressed pushes down on the portion of the light guiding sheet 30 corresponding to the spring 22. To dispose the rubber sheet 64 in a stable manner relative to the sheet switch module 71, a level of the rubber sheet 64 may be adjusted by inserting a spacer (not shown) between the rubber sheet 64 and the sheet switch module 71.

The surface sheet 66 is configured to form a display surface of an operational panel of an electronic instrument in which the sheet switch module 71 is installed. The surface sheet 66 is generally made of a soft resinous material such as rubber of the like. The key top 65 is disposed to face the past of the rubber sheet 64 to be pressed. The surface sheet 66 is disposed to cover an upper surface of the rubber sheet 64. In addition, the key top 65 has a light guiding property and a surface on which various letters, marks or the like are printed or formed in a concave and convex shape. A light shielding member is formed on portions of the surface sheet 66 except for the key tops 65. By providing a metallic film on a back surface of the light shielding member, it is possible to enhance the light guiding action within the light guiding sheet 30.

Light emitted tom the LED 34*a* of the sheet switch module 71 is guided to all parts of the light guiding sheet 30. Light which has been guided to the spring 22 is reflected upwardly on the spring 22 which is made of metal. The light reflected on the spring 22 is input through the rubber sheet 64 in the key top 65 to brightly illuminate an upper surface (operational surface) of the key top 65. As mentioned above, because the light guiding sheet 30 is closely fitted to the top surface of the spring 22 which is curved in a dome like shape, there is no leakage of the light which has been guided to the spring 22 thus allowing more light to be reflected toward the kelp top 65; therefore the key top can be brightly illuminated.

In the sheet switch according to the present invention because the spring is covered by the relatively thin light guiding sheet 30 which is closely fitted to the spring, the entire thickness of the sheet switch can be thinned to about the same degree as the height of the spring. Because the light guiding sheet has a light guiding property when the light emitted from the LED is guided within the light guiding sheet 30, the light can pass through the light guiding sheet 30 to allow the spring to be brightly illuminated. When a plurality of springs are arranged on the light guiding sheet 30 in a closely fitted state, a sheet switch with a multiple array of key switches can be formed. Because the entire sheet switch 21 according to the present invention is formed by a thin light guiding sheet, it is freely flexible.

Moreover, because the sheet switch module 31 is structured from the circuit board 33 and the sheet switch 21 disposed on the circuit hoard, the sheet switch module 31 can be installed in a panel switch formed in a curved surface shape matching a shape of an electronic instrument or the like, without being limited to the planar panel switch as shown in the above-mentioned embodiments.

Because the sheet switch module according to the present invention is configured to provide the sheet switch with the above-mentioned structure on the circuit board on which the LED is mounted and the light focusing member formed by the transparent resin such that no gap arises between the LED and the light guiding sheet, there is no leakage in the light emitted from the LED and the light can be guided efficiently along the light guiding sheet.

In addition, in the sheet switch module according to the present invention, because the light guiding sheet which corresponds to a light guiding plate to illuminate the spring is attached to the spring, there is no necessity to provide the light guiding plate separate from the spring, as in the case of the prior art, and the key top is not required; therefore the thinnest possible sheet switch module may be provided.

Because the panel switch has a thin and flat structure by virtue of the sheet switch module with the above-mentioned structure and the surface sheet with the key tops on which the various switch functions are displayed, the panel switch can be installed without any trouble in a thin electronic instrument such as a mobile phone. Moreover, because the springs can be efficiently illuminated by the light guiding sheet or LEDs provided on the sheet switch module, the number of LEDs can be reduced, so that a saving in electric power can be achieved without any lowering of emission brightness.

Although the preferred embodiments have been described, it should be noted that the present invention is not limited to these embodiments, and various modifications and changes can be made to the embodiments.

What is claimed is:

1. A sheet switch module, comprising:

a circuit board;

a structure wherein a central contact is disposed on the circuit board, a circumferential contact is disposed circumferentially of the central contact on the circuit board and a spring is disposed on the circumferential contact over the central contact;

a light guiding sheet formed by a transparent or light-transmitting resinous film, covering and closely fitting with an upper surface of the spring; and a light source that emits light into the light guiding sheet, wherein the spring forms a switching circuit and the spring provides electrical conduction between the central contact and the circumferential contact when the light guiding sheet is pressed, wherein a plurality of the structures are provided, the light source is disposed close to an end portion of the light guiding sheet, wherein the light guiding sheet covering the springs of the structures is configured such that a thickness of the light guiding sheet gradually reduces from a peripheral edge portion of each of the springs to a corresponding central portion of each of the springs and the light guiding sheet is configured to guide light emitted from the light source along an upper surface above each of the springs, and wherein a gap formed between the light source and the light guiding sheet is filled with a transparent resin.

2. The sheet switch module according to claim 1, wherein a light-focusing member including an inflated portion that covers an area above the light source and including a reduced portion that extends smoothly from the inflated portion to the light guiding sheet is disposed to cover the light source to focus light emitted from the light source.

3. A flat panel switch comprising:

the sheet switch module as recited in claim 1; and a surface sheet including key top portions disposed above the springs of the sheet switch module.

4. A sheet switch module, comprising:

a circuit board;

a structure wherein a central contact is disposed on the circuit board, a circumferential contact is disposed circumferentially of the central contact on the circuit board and a spring is disposed on the circumferential contact over the central contact;

a light guiding sheet formed by a transparent or light-transmitting resinous film, covering and closely fitting with an upper surface of the spring; and a light source that emits light into the light guiding sheet, wherein the spring forms a switching circuit and the spring provides electrical conduction between the central contact and the circumferential contact when the light guiding sheet is pressed, wherein a plurality of the structures are provided, wherein the light guiding sheet covering the springs of the structures has a thickness that gradually reduces from a peripheral edge portion of each of the springs to a central portion of the each of the springs and the light guiding sheet is configured to guide light emitted from the light source along an upper surface above each of the springs, and wherein a concave portion to contain the light source is provided in the light guiding sheet, and a gap formed between the light source contained in the concave portion and a concave cut surface is filled with a transparent resin.

5. The sheet switch module according to claim 4, wherein the concave portion is a hole provided in a place other than an end portion of the light guiding sheet.

6. The sheet switch module according to claim 4, wherein a light-focusing member including an inflated portion that covers an area above the light source and including a reduced portion that extends smoothly from the inflated portion to the light guiding sheet is disposed to cover the light source to focus light emitted from the light source.

7. A flat panel switch comprising:

the sheet switch module as recited in claim 4; and a surface sheet including key top portions disposed above the springs of the sheet switch module.

8. A sheet switch module, comprising:

a circuit board;

a structure wherein a central contact is disposed on the circuit board, a circumferential contact is disposed circumferentially of the central contact on the circuit board and a spring is disposed on the circumferential contact over the central contact;

a light guiding sheet formed by a transparent or light-transmitting resinous film, covering and closely fitting with an upper surface of the spring; and a light source that emits light into the light guiding sheet, wherein the spring forms a switching circuit and the spring provides electrical conduction between the central contact and the circumferential contact when the light guiding sheet is pressed, wherein a plurality of the structures are provided, wherein the light guiding sheet covering the springs of the structures has thickness that gradually reduces from a peripheral edge portion of each of the springs to a central portion of the each of the springs and the light guiding sheet is configured to guide light emitted from the light source along an upper surface above each of the springs, and wherein a light focusing member is disposed to cover the light source and configured to focus light emitted from the light source on the light guiding sheet, the light focusing member including an inflated portion disposed to cover the area above the light source and a reduced portion formed to extend smoothly from the inflated portion to the light guiding sheet.

9. A flat panel switch comprising:

the sheet switch module as recited in claim 8; and a surface sheet including key top portions disposed above the springs of the sheet switch module.

10. A sheet switch module, comprising:

a circuit board;

a structure wherein a central contact is disposed on the circuit board, a circumferential contact is disposed circumferentially of the central contact on the circuit board and a spring is disposed on the circumferential contact over the central contact;

a light guiding sheet formed by a transparent or light-transmitting resinous film, covering and closely fitting with an upper surface of the spring; and a light source that emits light into the light guiding sheet, wherein the spring forms a switching circuit and the spring provides electrical conduction between the central contact and the circumferential contact when the light guiding sheet is pressed, wherein a plurality of the structures are provided, the light source is disposed at an outer circumferential portion of the light guiding sheet, wherein the light guiding sheet covering the springs has a thickness that gradually reduces from a peripheral edge portion of each of the springs to a central portion of the each of the springs and the light guiding sheet is configured to guides light emitted from the light source along an upper surface above each of the springs, and wherein a light reflection member is provided on a lower surface of the light source.

11. The sheet switch module according to claim 10, wherein the light guiding sheet is adhered to an upper surface of each of the springs through an adhesive.

12. The sheet switch module according to claim 10, wherein the light guiding sheet has a raised portion configured to change a course of light in a circumferential vicinity of each of the springs.

13. The sheet switch module according to claim 10, wherein an emboss portion is formed on the light guiding sheet corresponding to an outer shape of each of the springs.

14. The sheet switch module according to claim 10, wherein the light guiding sheet is formed by a material which has a thickness in a range of 0.05mm to 0.3mm and the material is one selected from or a combination of acrylic resin, silicone resin, polycarbonate resin or polyethylene terephthalate resin.

15. The sheet switch module according to claim 10, wherein a mirror-surface portion for reflection is formed on an upper surface of each of the springs.

16. The sheet switch module according to claim 10, wherein a light reflection member is disposed on an upper surface of the light source.

17. The sheet switch module according to claim 10, wherein the light source comprises at least one light emitting diode element.

18. A flat panel switch comprising:

the sheet switch module as recited in claim 10; and a surface sheet including key top portions disposed above the springs of the sheet switch module.

19. The sheet switch module according to claim 10, wherein a concave and convex portion for scattering light is formed on the upper surface of the spring.

20. The sheet switch module according to claim 10, wherein a light-focusing member including an inflated portion that covers an area above the light source and including a reduced portion that extends smoothly from the inflated portion to the light guiding sheet is disposed to cover the light source to focus light emitted from the light source.

* * * * *